US007216679B2

(12) United States Patent
Magno, Jr. et al.

(10) Patent No.: US 7,216,679 B2
(45) Date of Patent: May 15, 2007

(54) CABLE TIE TOOL HAVING MODULAR TOOL HEAD

(75) Inventors: Joey D. Magno, Jr., Cordova, TN (US); Johan Tapper, Hedemora (SE); Anders Fahlen, Skedvi (SE); Joakim Norin, Stockholm (SE); Goran Paulsson, Mora (SE); Sven Wadling, Smedjebacken (SE)

(73) Assignee: Thomas & Betts International, Inc., Wilmington, DE (US)

( * ) Notice: Subject to any disclaimer, the term of this patent is extended or adjusted under 35 U.S.C. 154(b) by 106 days.

(21) Appl. No.: 11/055,929

(22) Filed: Feb. 11, 2005

(65) Prior Publication Data

US 2005/0178459 A1 Aug. 18, 2005

Related U.S. Application Data

(60) Provisional application No. 60/544,362, filed on Feb. 13, 2004.

(51) Int. Cl.
*B21F 9/00* (2006.01)
*B21F 9/02* (2006.01)

(52) U.S. Cl. ..... 140/123.6; 140/93.2

(58) Field of Classification Search ..... 140/123.6, 140/93.2, 93 R, 122, 124; 30/500; 403/321
See application file for complete search history.

(56) References Cited

U.S. PATENT DOCUMENTS

| | | | |
|---|---|---|---|
| 3,157,361 | A | 11/1964 | Heard |
| 3,633,633 | A | 1/1972 | Countryman |
| 3,853,155 | A | 12/1974 | Kabel |
| 3,865,156 | A | 2/1975 | Moody et al. |
| 4,047,545 | A | 9/1977 | Paradis |
| 4,083,497 | A | 4/1978 | Rosenberger |
| 4,093,005 | A | 6/1978 | Eberhardt et al. |

(Continued)

FOREIGN PATENT DOCUMENTS

| | | | |
|---|---|---|---|
| EP | 0 299 387 | A | 1/1989 |

(Continued)

OTHER PUBLICATIONS

U.S. Appl. No. 29/185,986, filed Jul. 7, 2003, Magno, Jr. et al., USPTO Filing Receipt, specification and drawings.

(Continued)

*Primary Examiner*—Lowell A. Larson
*Assistant Examiner*—Teresa M. Bonk
(74) *Attorney, Agent, or Firm*—Hoffmann & Baron, LLP

(57) ABSTRACT

The cable tie tool has a modular tool head and a tool handle from which the tool head may be detached. The attachment and detachment provided by the modular tool head provides for the use of multiple tool heads with a single tool handle in which is mounted a trigger mechanism. Each modular tool head is secured to the tool handle by a latch mechanism. Each tool head further includes a tensioning mechanism for applying a tension force to a cable tie. Each tensioning mechanism provides for application of a corresponding tension force to the cable tie proportional to the force applied to the tensioning mechanism by the trigger mechanism. The respective tension forces are different for at least one uniform force applied by the trigger mechanism to the corresponding tensioning mechanisms.

10 Claims, 18 Drawing Sheets

U.S. PATENT DOCUMENTS

| | | | |
|---|---|---|---|
| RE29,973 | E | 4/1979 | Paradis |
| 4,192,358 | A | 3/1980 | Bone |
| 4,410,019 | A | 10/1983 | Suzuki |
| 4,534,817 | A | 8/1985 | O'Sullivan |
| 4,548,242 | A | 10/1985 | Paradis |
| 4,609,149 | A | 9/1986 | Jessen |
| 4,718,460 | A | 1/1988 | Sato |
| 4,726,403 | A | 2/1988 | Young et al. |
| 4,791,968 | A | 12/1988 | Pearson |
| 4,793,385 | A | 12/1988 | Dyer et al. |
| D306,390 | S | 3/1990 | Dyer |
| 4,997,011 | A | 3/1991 | Dyer et al. |
| 5,000,232 | A | 3/1991 | Wolcott |
| 5,123,456 | A | 6/1992 | Jansen |
| 5,176,327 | A | 1/1993 | Petersen et al. |
| 5,392,822 | A | 2/1995 | Kraus |
| 5,431,659 | A | 7/1995 | Ross, Jr. et al. |
| 5,492,156 | A | 2/1996 | Dyer et al. |
| 5,518,043 | A | 5/1996 | Cheung et al. |
| D370,962 | S | 6/1996 | Aquilina |
| 5,566,726 | A | 10/1996 | Marelin |
| 5,595,220 | A | 1/1997 | Leban et al. |
| 5,667,143 | A | 9/1997 | Sebion et al. |
| 5,769,133 | A | 6/1998 | Dyer et al. |
| 5,832,964 | A | 11/1998 | Joshi |
| 5,915,425 | A | 6/1999 | Nilsson et al. |
| 6,039,089 | A | 3/2000 | Kurmis |
| 6,047,741 | A | 4/2000 | Kurmis |
| D430,781 | S | 9/2000 | Hillegonds |
| 6,206,053 | B1 | 3/2001 | Hillegonds |
| 6,513,555 | B1 | 2/2003 | Lesser et al. |
| D491,430 | S | 6/2004 | Magno, Jr. et al. |
| 2005/0005993 | A1 | 1/2005 | Magno, Jr. et al. |

FOREIGN PATENT DOCUMENTS

| | | |
|---|---|---|
| EP | 1 108 649 | 6/2001 |
| EP | 1 564 145 A1 | 8/2005 |
| GB | 1577957 | 10/1980 |
| GB | 2 240 601 A | 8/1991 |
| JP | 2000-168724 | 6/2000 |
| JP | 2000 168724 | 6/2000 |
| JP | 2002 321705 | 11/2002 |

OTHER PUBLICATIONS

Fiskars, "PowerGear Bypass Pruner", The Home Depot, before May 20, 2003 (approximately Feb. 2003), enlargement of illustration.

Fiskars, "Ergonomics, The Development of Vineyard Cutting Tools", Aug. 29, 2003.

European Search Report for European Patent Application No. EP 04 25 3852, including Annex, attached to European Patent Office Communication dated Jan. 21, 2005 (5 pages).

Partial European Search Report for European Patent Application No. EP 05 07 5328, including Annex, Abstract for EP Application No. 05075328.4, and Lack of Unity of Invention—Sheet B (4 pages).

European Search Report (including Annex) for European Application No. 05 07 5329, May 12, 2005 (4 pages).

"communication pursuant to Article 96(2) EPC", European Patent Office, European Patent Application No. 04 253 852.0—1261, Jun. 7, 2006 (4 pages).

"Notification of Reason for Refusal", Japanese Patent Office, Japanese Patent Application No. 2004-200020, Dec. 19, 2005 (Japanese language, 2 pages, English language translation, 1 page).

Office communication, U.S. Appl. No. 10/614,435, Sep. 26, 2005 (13 pages).

Office communication, U.S. Appl. No. 10/614,435, Jun. 28, 2006 (5 pages).

PCT Notification of Transmittal of the International Search Report and the Written Opinion of the International Searching Authority, or the Declaration for International Application No. PCT/US2005/009319, Jul. 6, 2005 (3 pages).

PCT International Search Report for International Application No. PCT/US2005/009319, Jul. 6, 2005 (4 pages).

PCT Written Opinion of the International Searching Authority for International Application No. PCT/US2005/009319, Jul. 6, 2005 (4 pages).

Office Action, Canadian Intellectual Property Office, Canadian Patent Application No. 2,471,183, Jun. 28, 2006 (3 pages).

15b
36
65b
157b
10b
12b
22b
164b
165b
163b
27b
90
87
75
70
72
67
82
77
30
80
39
142b
37b
154b
52
53
57
55
40
35
38
37
169
97b
167b
172
92b
41
35b 15b
142b
37b
49
10b
154b
46
164b
165b
163b
65b
157b
12b
22b
27b
90
87
75
70
72
67
85
77
30
80
52
53
57
45
48
47
50
55
169
167b
97b
172
92b
51
35b

CABLE TIE TOOL HAVING MODULAR TOOL HEAD

CROSS-REFERENCE TO RELATED APPLICATION

This patent application claims priority to and the benefit of U.S. Provisional Patent Application No. 60/544,362 filed in the U.S. Patent and Trademark Office (USPTO) on Feb. 13, 2004.

BACKGROUND OF THE INVENTION

The present invention relates generally to a cable tie tool having a modular tool head, and more specifically, to such a tool head which may be detachably secured to the tool handle of the cable tie tool.

Cable ties are used to bundle or secure a group of articles such as electrical wires or cables. Cable ties of conventional construction include a cable tie head and an elongate strap extending therefrom. The strap is wrapped around a bundle of articles and thereafter inserted through a passage in the head. The head of the cable tie typically supports a locking element which extends into the head passage allowing the strap to be inserted through the passage but preventing retraction of the strap through the passage in the head. Two longitudinally separated portions of the strap are thereby secured to the head to define a loop for holding together the group of articles.

In use, the installer manually places the tie about the articles to be bundled, inserts the strap through the head passage and then manually tightens the tie about the bundle. Further tightening of the cable tie, which increases the tension in the strap thereof, may be provided by a cable tie tool.

One type of such a cable tie tool includes a housing which is generally pistol-shaped where the housing has a barrel into which the strap may be inserted for application of the tension. The housing has a grip which depends from the barrel. The tool includes a trigger mechanism having a trigger link located under the barrel and in front of the grip. The trigger link is elongate and in generally depending relation relative to the barrel such that, when the heel of the hand of a user is placed against the grip such that the fingers of the user's hand extend forwardly, the fingers may encircle the forward surface of the trigger link. Forcibly drawing the fingers toward the heel of the hand, i.e., squeezing the trigger link and grip, causes the trigger link to be displaced toward the grip. The trigger mechanism extends into the housing and is able to grasp the strap, and to apply the predetermined tension thereto in proportion to the drawing or squeezing force applied to the trigger link.

Cable tie tools are typically able to apply a specific range of tension forces to a cable tie where such a range is typically defined a minimum and maximum force. If the range of tension forces which a particular tool can apply does not include the force required by a particular cable tie, then a different tool would be normally be required for such a cable tie. Cable ties may be constructed in a wide variety of sizes which require an equally wide variety of force magnitudes to properly tension the cable ties. Because of the limitations in the range of forces any particular installation tool can apply to a cable tie, more than one installation tool would typically be required to apply proper tension forces to a wide variety of cable ties. Accordingly, if a wide variety of cable ties are to be used, more than one cable tie tool would normally be required.

The use of multiple cable tie tools has disadvantages. For example, having to carry the multiple tools is typically cumbersome. Also, having to switch from using one tool to another is normally a burden.

SUMMARY OF THE INVENTION

The cable tie tool of the present invention has a modular tool head and a tool handle from which the tool head may be detached. The attachment and detachment provided by the modular tool head provides for the use of multiple tool heads with a single tool handle in which is mounted a handle linkage.

Each modular tool head is secured to the tool handle by a latch mechanism. Each tool head further includes a tensioning mechanism for applying a tension force to a cable tie. Each tool head has a joint for coupling the corresponding tensioning mechanism to the trigger mechanism such that a gripping force applied to the trigger mechanism is transmitted to the corresponding tensioning mechanism. The joint provides for coupling and decoupling of the trigger and tensioning mechanisms based on the relative positions thereof. The joint facilitates coupling and decoupling of the trigger and tensioning mechanisms and, accordingly, the attachment of multiple tool heads to the tool handle, and the removal of the tool heads therefrom. Each tensioning mechanism provides for application of a corresponding tension force to the cable tie proportional to the force applied to the tensioning mechanism by the trigger mechanism. The respective tension forces are different for at least one uniform force applied by the trigger mechanism to the corresponding tensioning mechanisms.

The multiple tool heads thereby provide for a single tool handle to apply different tension forces to cable ties by using different tool heads with the tool handle. This provides numerous advantages. For example, when the tool handle and tool head are used to tension a cable tie, the user's hand normally grasps the tool handle, typically the grip thereof, and the hand is forcibly closed around the grip to apply tension to the cable tie. The hand of the user may continue to grasp the grip of the tool handle throughout its entire use, including during removal and reattachment of the tool heads thereto. Thus, the grasp of the tool handle by the user may continue uninterrupted while the single tool handle provides a wide range of tension forces to the cable tie by using different tool heads. Accordingly, a single tool handle may be used with a wide array of cable ties without requiring the grasp by the user of the tool handle to be released, thus substantially eliminating the burden normally associated with changing cable tie tools.

Also, the user may carry a single cable tie tool, including a single tool handle and multiple tool heads, and nevertheless be able to provide a wide range of tension forces by using the multiple tool heads. This wide range of tension forces enables the single tool handle, in combination with multiple tool heads, to be usable with a wide range of cable ties. This reduces the cumbersomeness which normally results from carrying multiple cable tie tools because multiple tool heads are normally significantly smaller and easier to manipulate as compared to multiple cable tie tools.

Methods of attaching the modular tool head of the present invention to the tool handle of the cable tie tool and removing the tool head therefrom facilitate use of a single tool handle with multiple tool heads.

These and other features of the invention will be more fully understood from the following description of specific embodiments of the invention taken together with the accompanying drawings.

BRIEF DESCRIPTION OF THE DRAWINGS

In the drawings.

Corresponding reference characters indicate corresponding parts throughout the several views of the drawings.

DETAILED DESCRIPTION OF THE INVENTION

Figure 2:
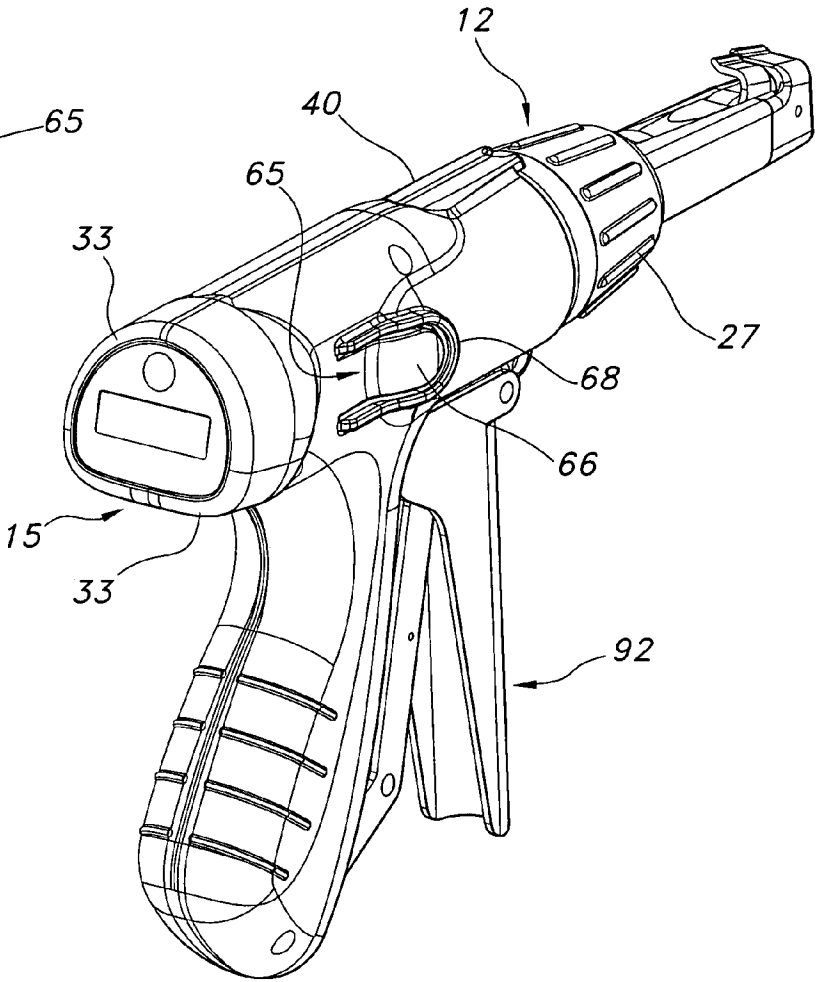
FIG. 2 is a rear perspective view of the modular tool head and tool handle of FIG. 1.
Figure 1:
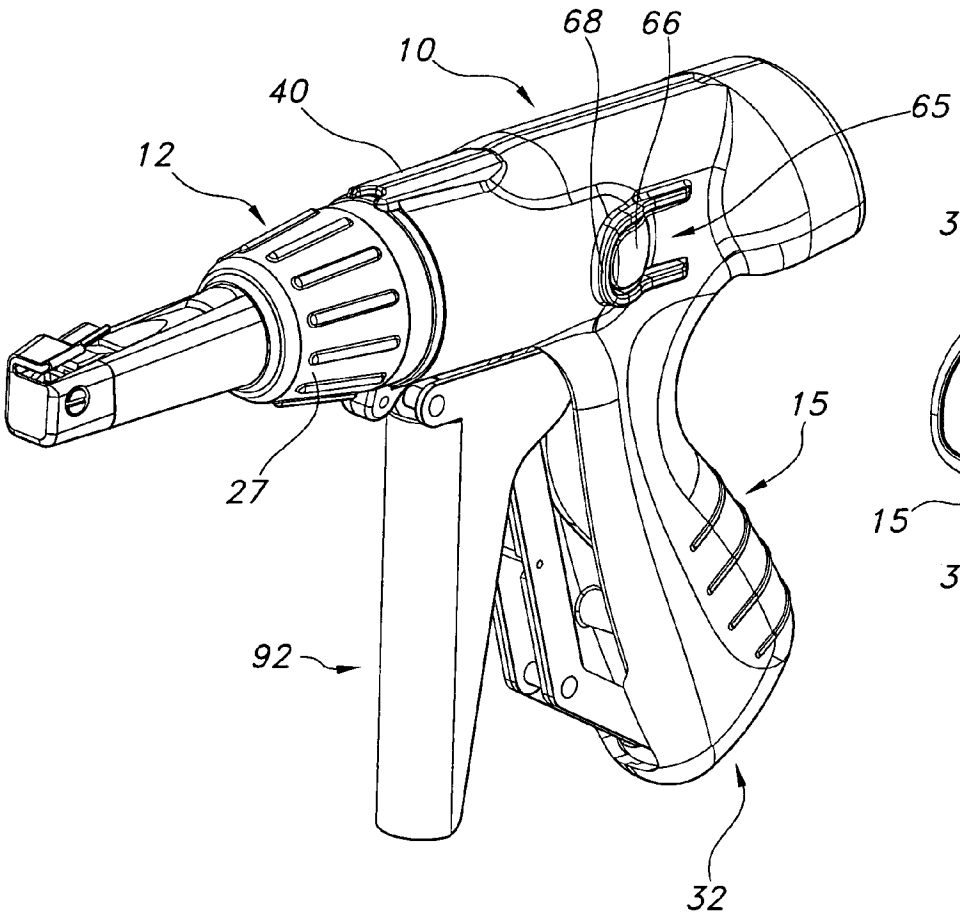
FIG. 1 is a front perspective view of the modular tool head connected to the tool handle for a cable tie tool of the present invention.
Figure 5:
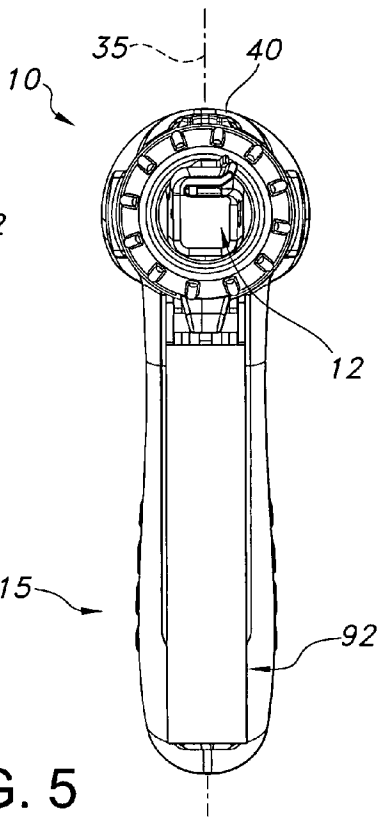
FIG. 5 is a front elevation view of the modular tool head and tool handle of FIG. 3.
Figure 4:
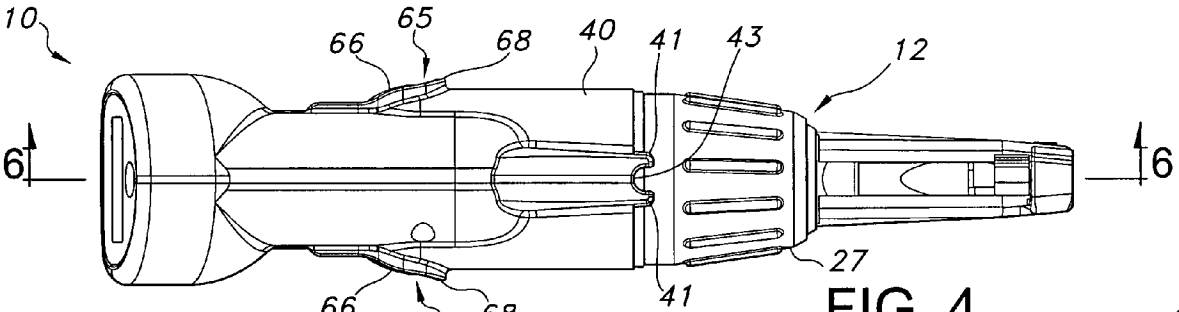
FIG. 4 is a top plan view of the modular tool head and tool handle of FIG. 3.
Figure 3:
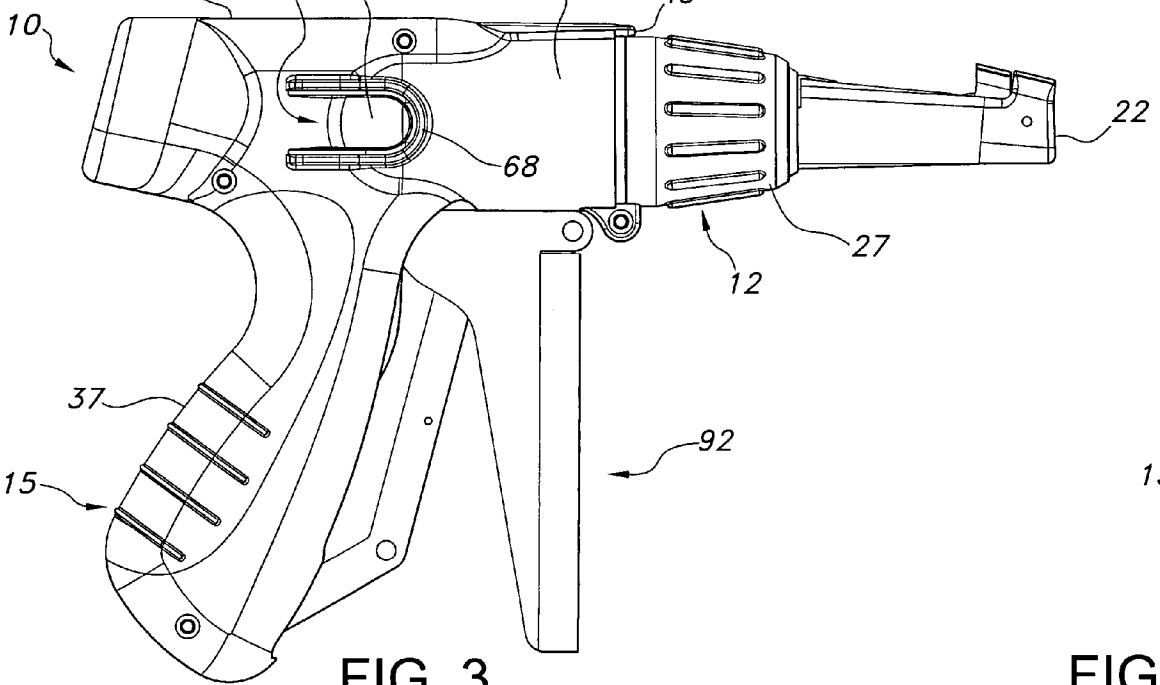
FIG. 3 is a side elevation view of the modular tool head and tool handle of FIG. 1.

Referring to the drawings and more particularly FIGS. 1 and 2, a cable tie tool 10 is shown for securing a cable tie to a bundle of articles, such as wires or cables. The cable tie tool 10 includes a modular tool head 12 and a tool handle 15.

Figures 6, 7:
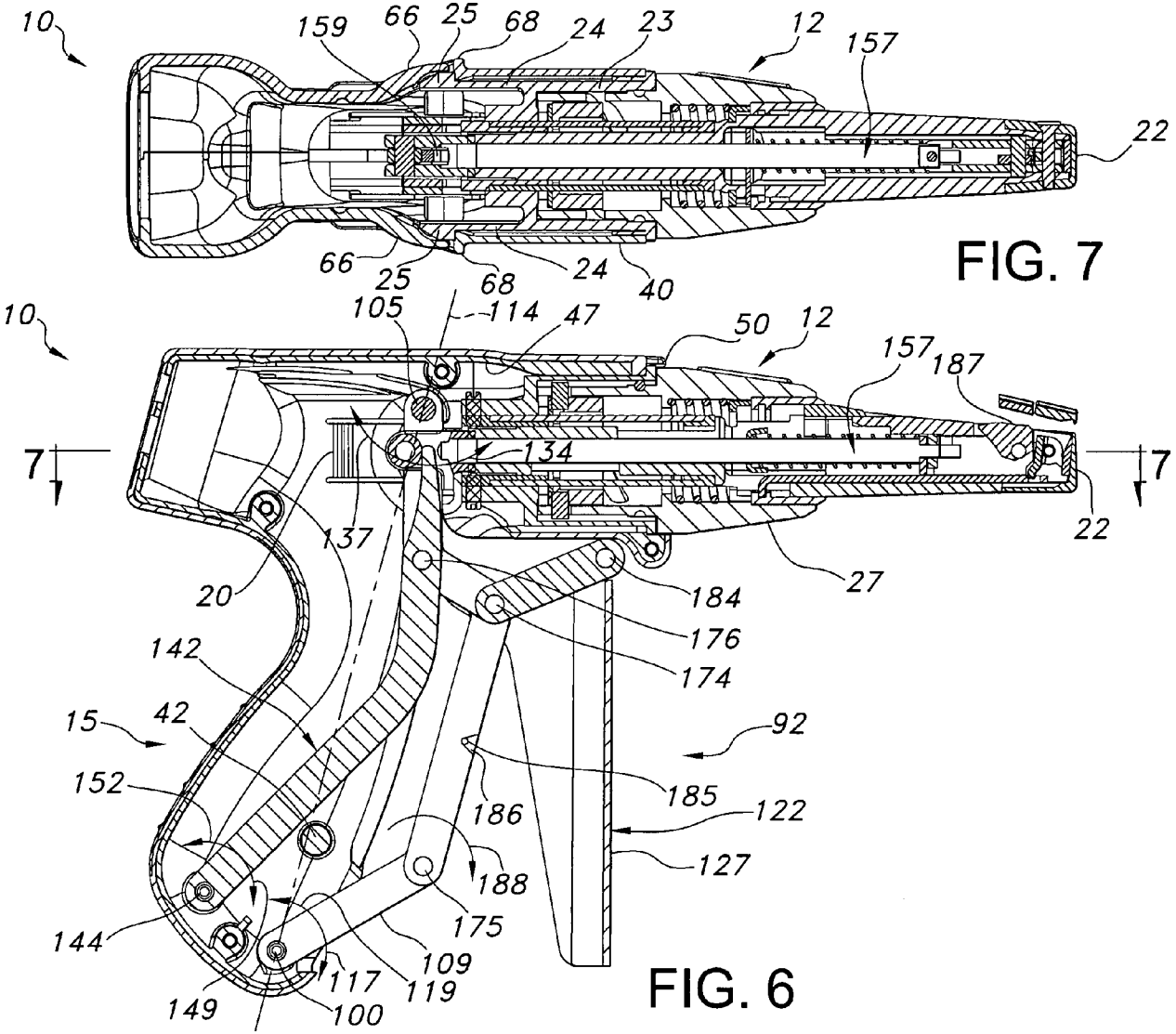
FIG. 6 is a cross-sectional view in the plane indicated by line 6—6 of FIG. 4 showing components located within the modular tool head and the linkage located within the tool handle.
FIG. 7 is a cross-sectional view in the plane indicated by line 7—7 of FIG. 6 showing components located within the modular tool head and tool handle.
Figure 21:
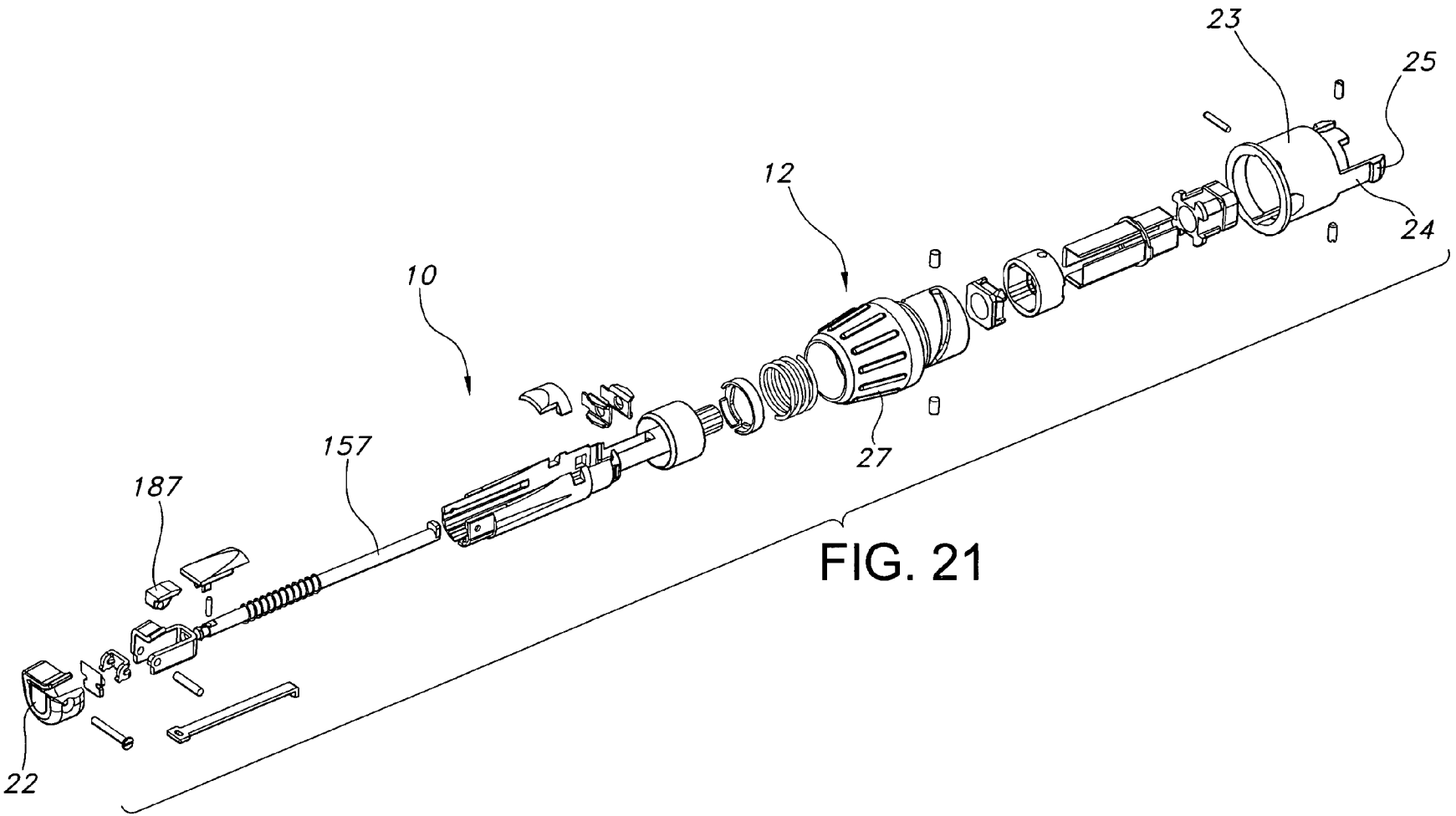
FIG. 21 is an exploded view of the modular tool head of FIG. 1.
Figure 23:
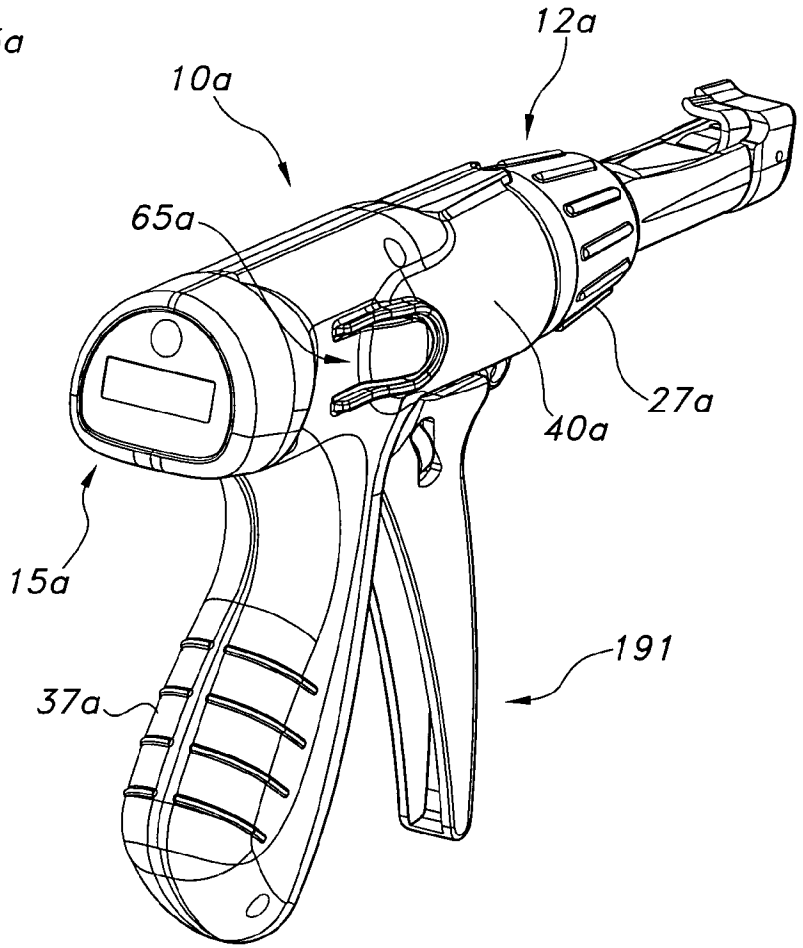
FIG. 23 is a rear perspective view of the modular tool head and tool handle of FIG. 22.
Figure 22:
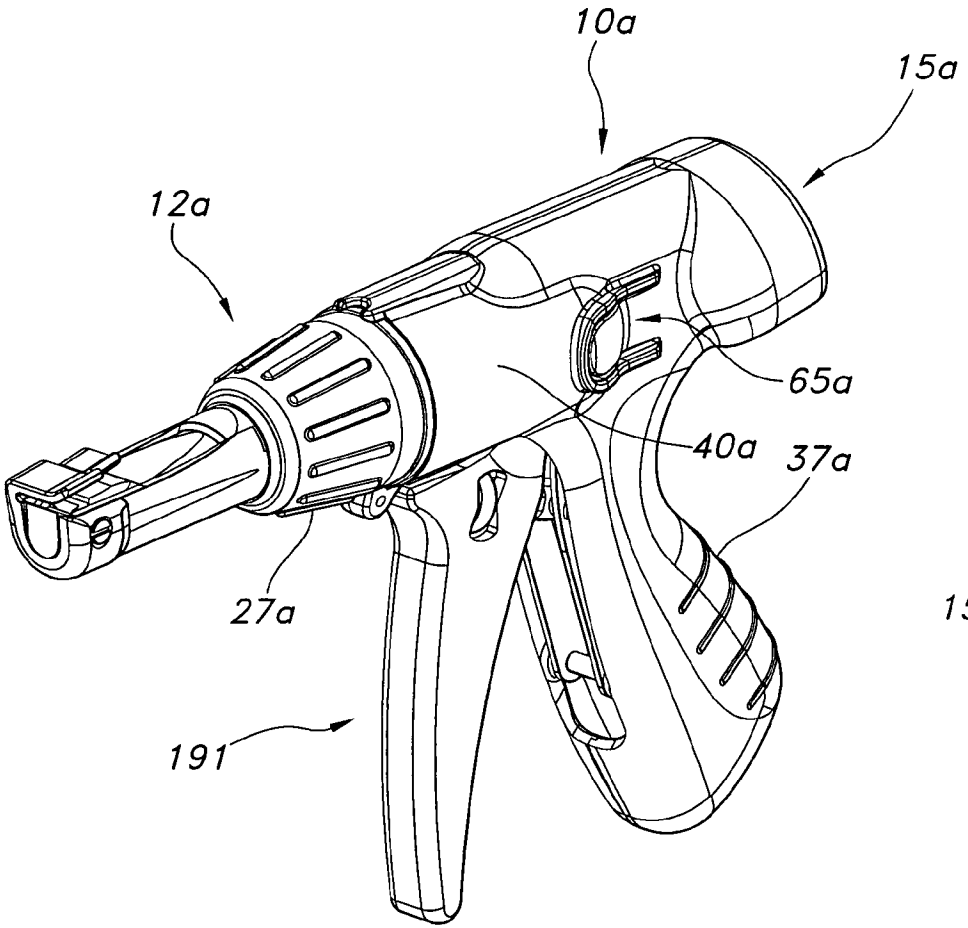
FIG. 22 is a front perspective view of a modular tool head and an alternative second embodiment of a tool handle of a cable tie tool of the present invention.
Figure 25:
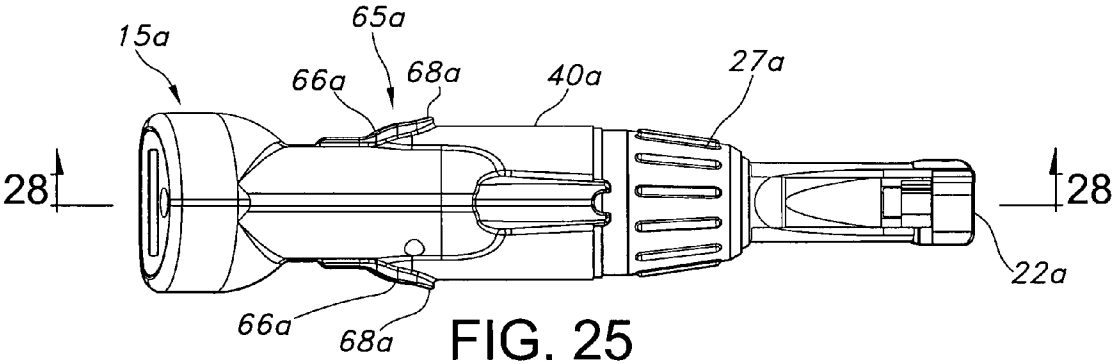
FIG. 25 is a top plan view of the modular tool head and tool handle of FIG. 24.
Figure 24:
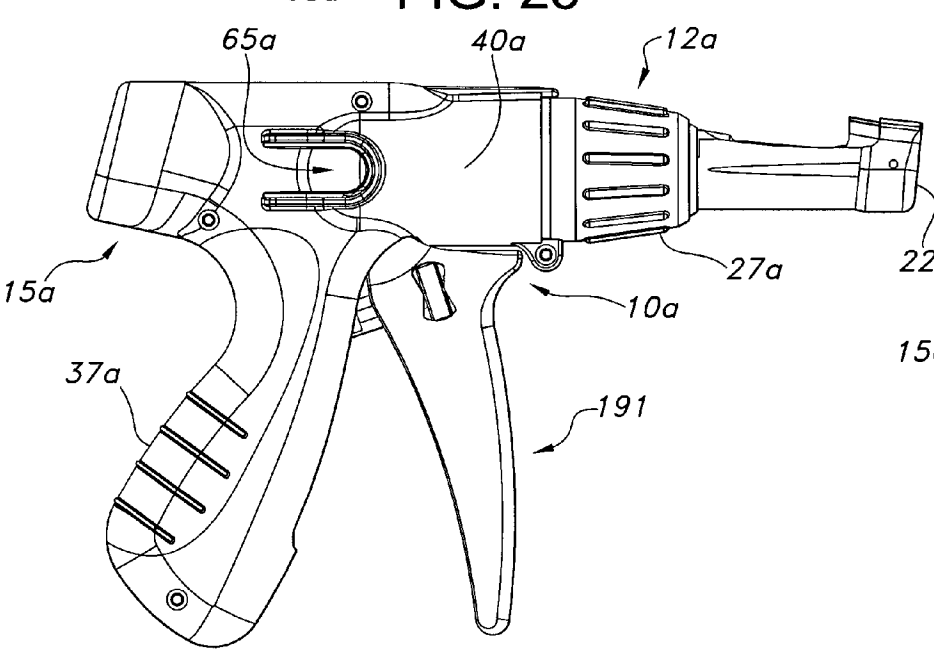
FIG. 24 is a side elevation view of the modular tool head and tool handle of FIG. 22.
Figure 26:
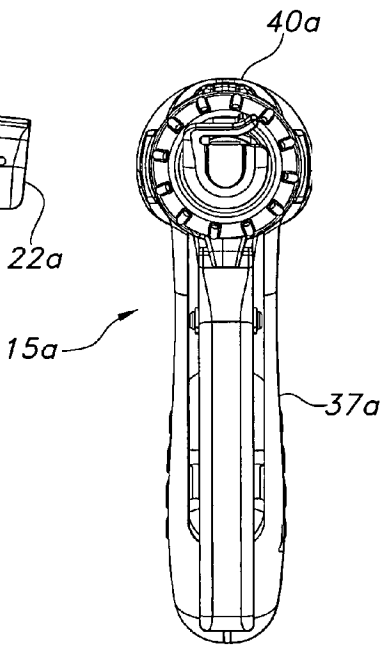
FIG. 26 is a front elevation view of the modular tool head and tool handle of FIG. 24.

The tool head 12 has proximal and distal ends 20, 22, and includes a tension adjustment knob 27 and other components, examples of which are disclosed in U.S. Provisional Patent Application 60/544,361 filed in the U.S. Patent and Trademark Office (USPTO) on even date herewith and entitled "Tension and Anti-Recoil Mechanism for Cable Tie Tool", having as the inventors Joey D. Magno, Jr., Johan Tapper, Anders Fahlen, Joakin Norin, Goran Paulsson and Sven Wadling. The tool head 12 includes a rear housing ring 23 located to the rear thereof, as shown in FIGS. 6, 7 and 21. The rear housing ring 23 has a pair of diametrically opposed arms 24 each of which extends rearwardly from the rear edge of the ring. The arms 24 each have rear end portions the outer surfaces of which have hook formations 25 thereon. The outer surface of the rear end of each hook formation 25 is chamfered, as shown in FIGS. 7 and 21. Examples of components which may be included in the tool head 12 are also disclosed in U.S. Pat. No. 5,915,425 issued Jun. 29, 1999.

The tool handle 15 includes a handle housing 32 having pistol-shape and a longitudinal central plane 35. The handle housing 32 includes a grip 37 which depends from a barrel 40. Mounted on the inner surface of the handle housing 32 within the grip 37 is a trigger stop 42 which is oriented such that the longitudinal axis of the stop is generally perpendicular to the central plane 35, as shown in FIG. 6. The barrel 40 has a distal end 45 and a longitudinal cylindrical passage 47 which terminates at an opening 50 which coincides with the distal end. The handle housing 32 may be formed from a pair of shell members 33 which are generally symmetrical relative to the central plane 35.

Corresponding indicator tabs 41 extend longitudinally from the portions of the respective shell members 33 which form the distal end 45 of the barrel 40. When the shell members 33 are joined together, the indicator tabs 41 define a semicircular recess 43 which locates the direction along which the tension setting number of the tool head 12 may be viewed.

The tool handle 15 includes a pair of latch mechanisms 65 each of which includes a lever 66 and a latch edge 68. Each of the latch edges 68 is generally vertical and faces the front end of a respective lever 66 in adjacent relation thereto. Each of the levers 66 has a longitudinal orientation and has a rear end which is integral with the barrel 40 of a respective shell member 33, as shown in FIG. 7. Each of the levers 66 and shell members 33 are formed of resilient material, such as plastic. The resiliency, for example at the junction between each lever 66 and the adjoining shell member 33, provides for outward deflection of each lever away from the adjoining shell member upon application to the respective lever of an outward deflection force which is generally transverse to the barrel 40. Removal of the deflection force from the levers 66 results in the levers returning to the neutral closed positions shown in FIGS. 1 and 7.

When the tool head 12, including the proximal end 20, is fully inserted in the passage 47 of the barrel 40, and the levers 66 are in the neutral closed positions, the hook formations 25 of the rear housing ring 23 engage the adjacent latch edges 68, as shown in FIG. 7, to prevent removal of the tool head from the barrel 40. Full insertion of the tool head 12 into the passage 47 of the barrel 40 results in the proximal end 20 of the tool head being longitudinally to the rear of the distal end 45 of the barrel, as shown in FIG. 6.

During rearward insertion of the tool head 12 into the passage 47 of the barrel 40, the hook formations 25 engage the inner surfaces of the portions of the shell members 33 which define the barrel 40. Such engagement causes the arms 24 of the rear housing ring 23 to deflect inwardly as a result of the chamfer of each hook formation 25 and the stiffness of the portions of the shell members 33 engaged by the hook formations. Continued rearward insertion of the tool head 12 into the passage 47 results that hook formations 25 becoming longitudinally positioned to the rear of the adjacent latch edges 68. This results in the arms 24 deflecting outward to the positions shown in FIG. 7 in which the hook formations 25 engage the adjacent latch edges 68.

Disengagement of the hook formations 25 from the latch edges 68 is provided by application of an inwardly directed force to each of the levers 66. Such a force causes the each of the levers 66 to inwardly deflect the adjacent arm 24 such that the corresponding hook formation 25 is displaced inwardly a sufficient distance to clear the adjacent latch edge 68. This removes the obstruction to forward displacement of the tool head 12 provided by the engagement between the hook formations and the corresponding latch edges 68. As result, the tool head 12 may be displaced forwardly for removal from the barrel 40.

Figure 8:
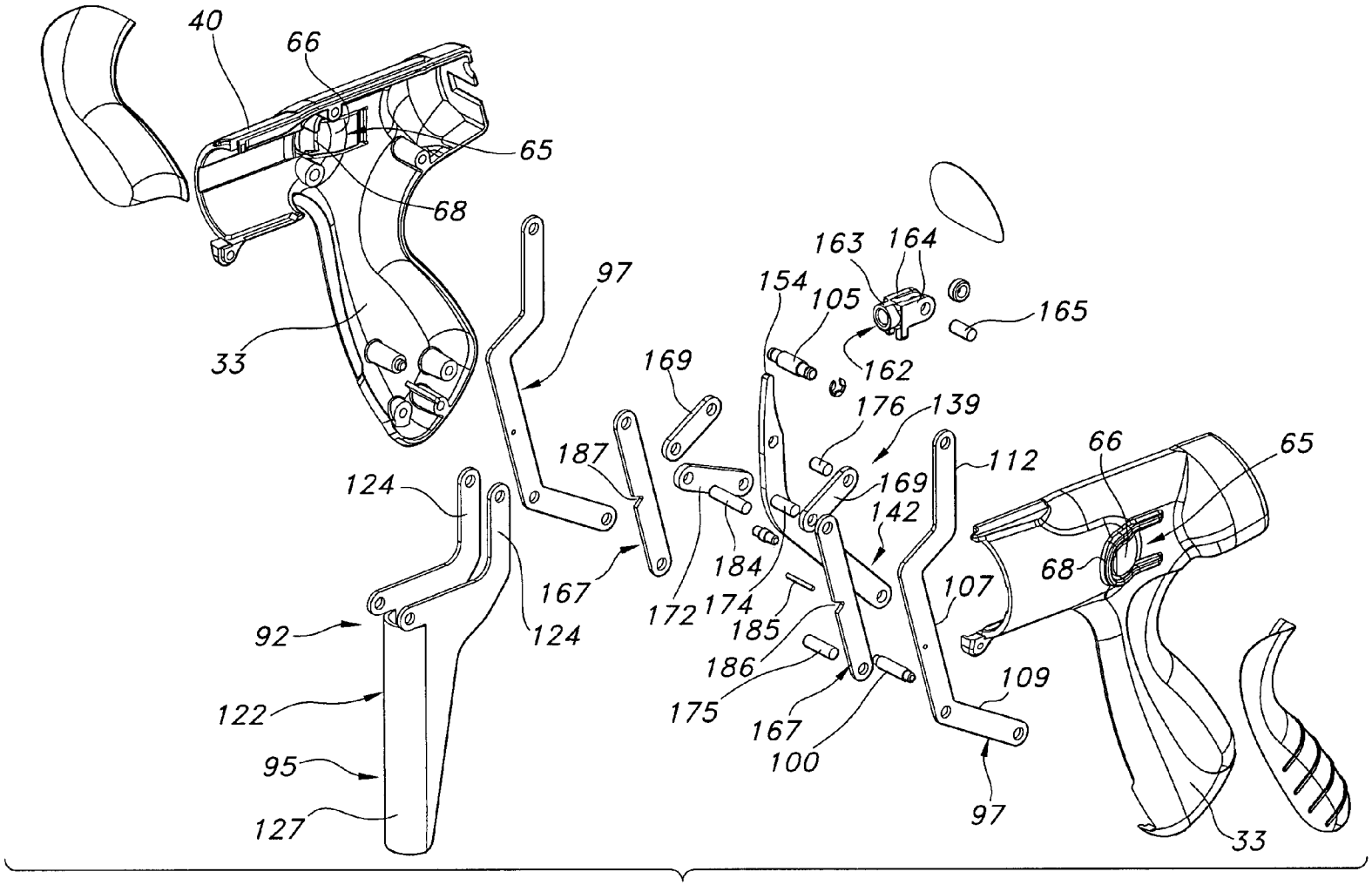
FIG. 8 is an exploded view of the tool handle of FIG. 1 showing the linkage located within the tool handle.
Figure 27:
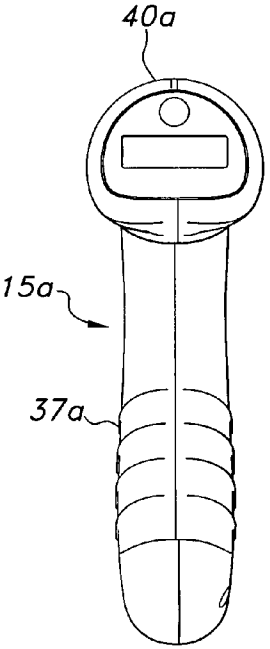
FIG. 27 is a rear elevation view of the modular tool head and tool handle of FIG. 24.

The tool handle 15 includes a trigger mechanism 92 having a trigger linkage 95 with a pair of elongate inner trigger links 97, as shown in FIGS. 6 and 8. The inner trigger links 97 each have a lower end which is pivotally connected to the grip 37 by a transverse pin 100 generally adjacent to the distal end thereof as shown in FIG. 6. The pin 100 may be formed of steel material. Each of the inner trigger links 97 has a longitudinal axis 102 which is generally parallel to the central plane 35, as shown in FIG. 27. The inner trigger links 97 each have an upper end through which extends a transverse pin 105, which may be formed of steel material.

The inner trigger links 97 each have an intermediate segment 107 between a lower segment 109 and an angled upper segment 112, as shown in FIG. 8. The intermediate segment 107 is inclined relative to the lower segment 109 and relative to the lower portion of the upper segment 112. This, and the angular shape of the upper segment 112, results in the intermediate segment 107 being forward of an inner axis 114 which intersects the pins 100, 105, as shown in FIG. 6. Each inner axis 114 is generally parallel to the central plane 35. The pivotal connections between the inner trigger links 97 and grip provided by the pin 100 enables pivoting of the inner trigger links in the directions 117, 119 toward open and closed positions, respectively.

Figure 11:
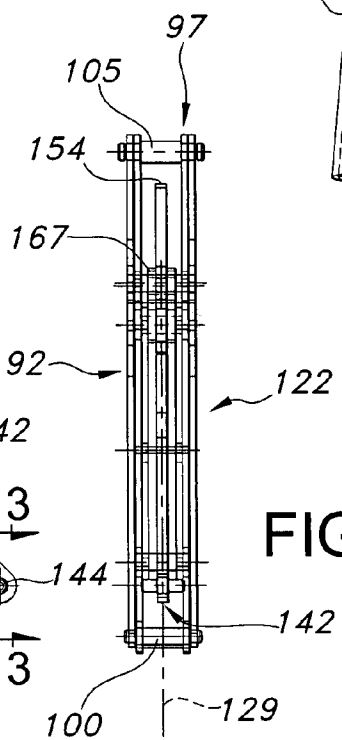
FIG. 11 is a rear elevation view of the trigger mechanism of FIG. 10.
Figure 12:
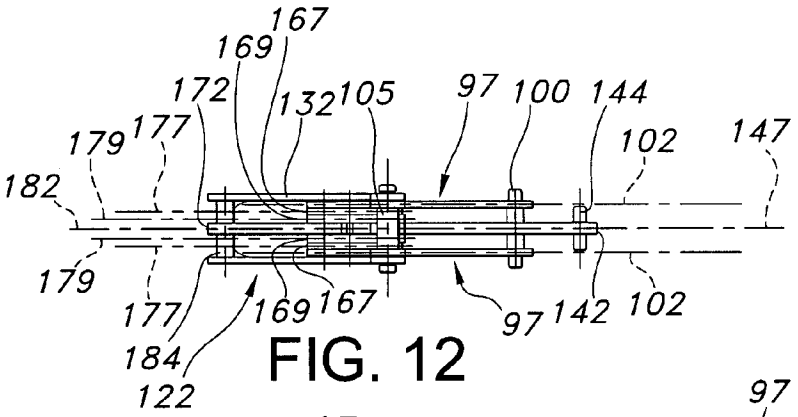
FIG. 12 is a top plan view of the trigger mechanism of FIG. 10.
Figure 20:
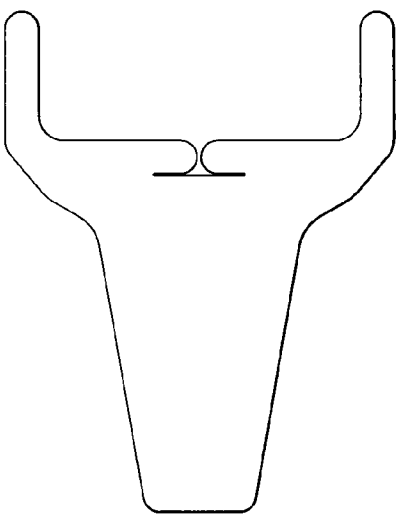
FIG. 20 shows a sheet from which the outer trigger link is formed.
Figure 19:
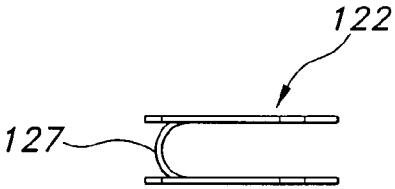
FIG. 19 is a top plan view of the trigger mechanism of FIG. 17.
Figure 17:
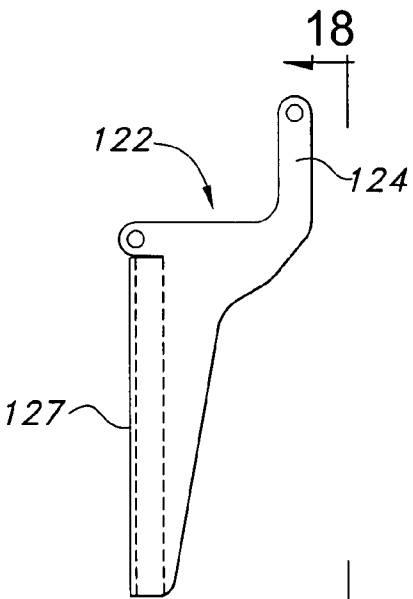
FIG. 17 is a side elevation view of the outer trigger link of FIG. 16.
Figure 18:
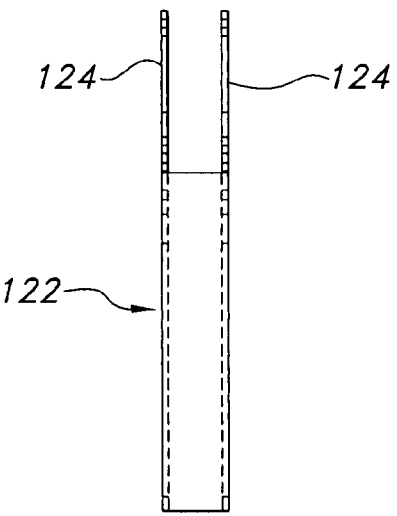
FIG. 18 is a rear elevation view of the outer trigger link of FIG. 17.

The cable tie tool 10 includes an outer trigger link 122 having a pair of upwardly extending arm portions 124 each of which is pivotally connected to the pin 105 such that the outer trigger link is pivotally connected to the inner trigger links 97. The outer trigger link 122 is a one-piece structure illustrated in FIGS. 16 to 20, and may be formed of steel material. The outer trigger link 122 includes a grip portion 127 having a U-shaped cross-section, as viewed in FIG. 19, depending from the arm portions 124 in integral relation therewith. The grip portion 127 has a longitudinal axis 129 which is generally contained in the central plane 35, as shown in FIGS. 11 and 12. The outer trigger link 122 is formed from a sheet, as shown in FIG. 20, which is formed of a deformable material such as metal. The outer trigger link 122 has a pair of shoulder portions 132 extending forwardly from the grip portion 127 at generally the same elevation as the lower ends of the arm portions 124.

The pivotal connections between the inner and outer trigger links 97, 122 provided by the pin 105 provides for the outer trigger link to pivot in the directions 134, 137 toward open and closed positions, respectively.

Figure 9:
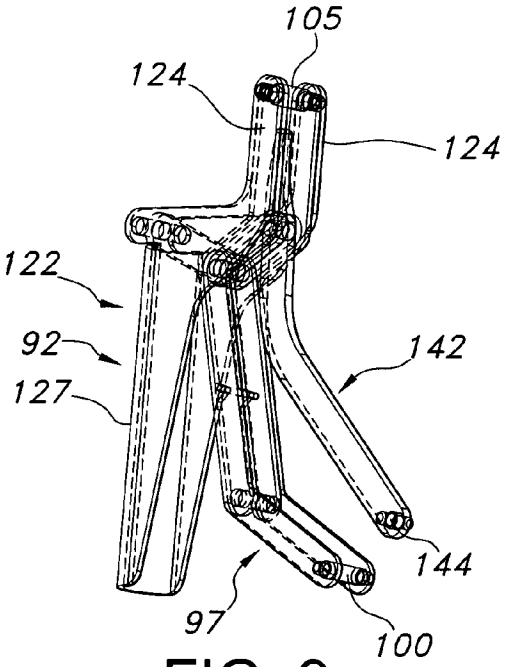
FIG. 9 is a perspective view of the trigger mechanism of FIG. 1.

The trigger mechanism 92 includes an intermediate linkage 139 having an elongate rod link 142, as shown in FIGS. 8 and 9. The lower end of the rod link 142 is pivotally connected to the grip 37 by a transverse pin 144 generally adjacent to the distal end thereof, as shown in FIG. 6. The pin 144 may be formed of steel material. The rod link 142 has a longitudinal axis 147 which is generally contained in the central plane 35, as shown in FIG. 12.

The pivotal connection provided by the pin 144 enables pivoting of the rod link 142 in the directions 149, 152 toward open and closed positions, respectively. Sufficient pivoting of the rod link 142 in the direction 149 results in the engagement of the rod link with the trigger stop 42 thereby providing a limit to such pivoting, as shown in FIG. 6.

The upper portion of the rod link 142 extends into the barrel 40. The upper end of the rod link 142 has a detent 154 which extends to an axially-reciprocating pull rod 157 of a tensioning mechanism located in the tool head 12, as shown in FIG. 7. The pull rod 157 has a proximal end 159 including a pull rod yoke 162 having a transverse yoke web 163 and a pair of yoke flanges 164 extending outwardly from the yoke web. The rear of pull rod yoke 162 is closed by a pull rod pin 165 which extends between the yoke flanges 164. The detent 154 is inserted within the pull rod yoke 162 so that the detent is forward of the pull rod pin 165 and thereby longitudinally fixed relative to the pull rod 157, as shown in FIG. 6. Accordingly, the pull rod 157 is axially displaced relative to the tool head 12 when the rod link 142 is pivoted in the directions 149, 152.

Figure 10:
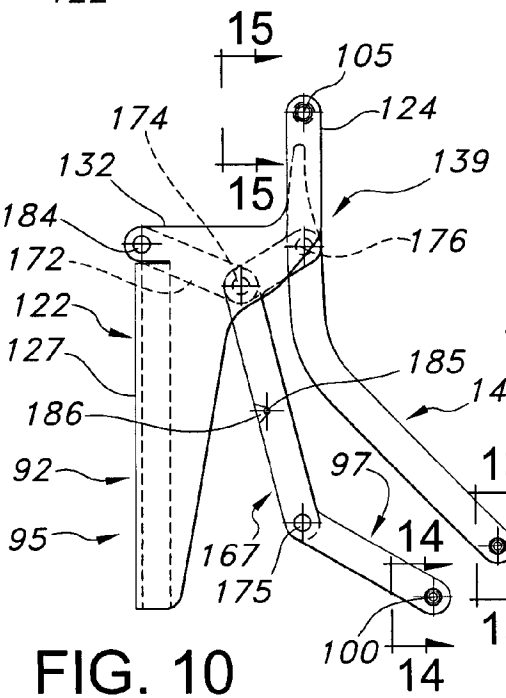
FIG. 10 is a side elevation view of the trigger mechanism of FIG. 9.
Figure 15:
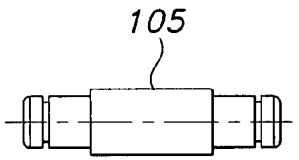
FIG. 15 is a front elevation view in the plane indicated by line 15—15 of FIG. 10 showing the pin which connects the inner trigger link to the outer trigger link.
Figure 14:
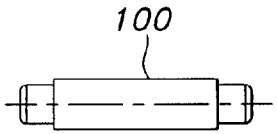
FIG. 14 is a front elevation view in the plane indicated by line 14—14 of FIG. 10 showing the pin which connects the inner trigger link to the tool handle.
Figure 13:
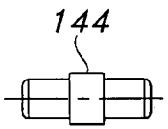
FIG. 13 is a front elevation view in the plane indicated by line 13—13 of FIG. 10 showing the pin which connects the rod link to the tool handle.
Figure 16:
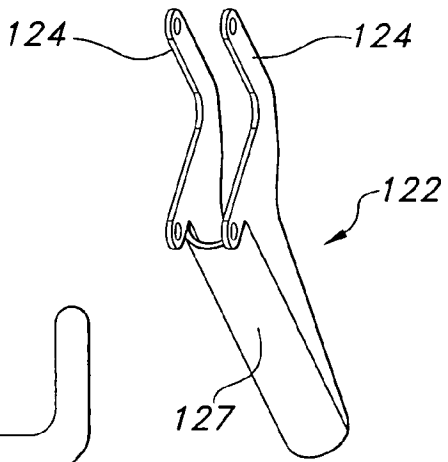
FIG. 16 is a perspective view of the outer trigger link of FIG. 9.

The intermediate linkage 139 further comprises a pair of central links 167, a pair of inner links 169, and an outer link 172, as shown in FIGS. 6 and 8. The respective central, inner and outer links 167, 169, 172 each have an end which is pivotally connected to an end of the other links at a transverse pin 174 such that the links have a generally Y-shaped configuration when the inner and outer trigger links 97, 122 are each in the respective positions shown in FIGS. 6 and 10. The pin 174 is flushed relative to the outer lateral surfaces of the inner trigger links 97.

The central links 167 each have a longitudinal axis 177 which is generally parallel to the central plane 35, as shown in FIG. 12. The inner links 169 each have a longitudinal axis 179 which is generally parallel to the central plane 35. The outer link 172 has a longitudinal axis 182 which is generally contained in the central plane 35.

The central links 167 each have an end opposite to the pin 174 which is pivotally connected to a respective one of the inner trigger links 97 by a transverse pin 175 which is flushed relative to the outer lateral surfaces of the inner trigger links 97. The inner links 169 each have an end opposite to the pin 174 which is pivotally connected to the rod link 142 by a transverse pin 176 which is flushed relative to the outer lateral surfaces of the inner links 169. The outer link 172 has an end opposite to the pin 174 which is pivotally connected to the outer trigger link 122 by a transverse pin 184 which is supported in the shoulder portions 132. The pin 184 is flushed relative to the outer lateral surfaces of the outer trigger link 122.

A transverse pin 185 is fixed to each of the inner trigger links 97. Each pin 185 is engaged by a recessed portion 187 of a respective central link 167 to limit rotation of the central link in the direction 188 relative to the corresponding inner trigger link 97. The pin 185 is flushed relative to the outer lateral surfaces of the inner trigger links 97.

In operation, the inner and outer trigger links 97, 122 are pivoted in the directions 117, 134 to the respective open positions. The strap of the cable tie is then secured to the pawl grip 187 of the tool head 12.

The user grasps the outer trigger link 122 and grip 37 of the handle housing 32 such that the fingers of the user's hand partially encircle the trigger link and the heel of the user's hand abuts the grip. The fingers are oriented along the outer trigger link 122 so that the larger fingers are between the smaller fingers and the barrel 40.

The user's hand is then closed causing the outer trigger link 122 to pivot in the direction 137 toward the closed position. Such pivoting of the outer trigger link 122 in the direction 137 produces a reverse sequential pivoting of the outer and inner trigger links 122, 97 as a result of the shape and size of the outer and inner trigger links and central, inner and outer links 167, 169, 172. This reverse sequential pivoting causes the displacement to produce an initial pivoting of the outer trigger link 122 relative to the inner trigger links 97 in an initial direction toward the closed position. This initial direction is the pivoting direction 137 of the outer trigger link 122 relative to the inner trigger links 97 about the pin 105. During the initial pivoting of the outer trigger link 122, pivoting of the inner trigger links 97 relative to the grip 37 is substantially limited. The initial pivoting causes pivoting of the central, inner and outer links 167, 169, 172 which, in turn, causes the rod link 142 to pivot in the direction 152 toward the closed position. The pivoting of the rod link 142 in the direction 152 toward the closed position produces axial displacement of the pull rod 157 in the proximal direction which, because of its coupling to the pawl grip 187, applies a tensile force to the cable tie.

The reverse sequential pivoting provides for continued displacement of the outer trigger link 122 toward the grip 37 to cause subsequent pivoting of the inner trigger links 97 relative to the grip in a subsequent direction toward the closed position. The subsequent pivoting is initiated when the outer trigger link 122 reaches the limit at which continued pivoting of the outer trigger link in the initial direction is substantially prevented. The subsequent direction is opposite from the initial direction, and is the pivoting direction 119 of the inner trigger links 97 relative to the grip 37 about the pin 100. During the subsequent pivoting, pivoting of the outer trigger link 122 relative to the inner trigger links 97 is substantially limited. The subsequent pivoting also causes pivoting of the central, inner and outer links 167, 169, 172 which, in turn, cause the rod link 142 to pivot further in the direction 152 toward the closed position. The further pivoting of the rod link 142 toward the closed position produces further axial displacement of the pull rod 157 in the proximal direction to apply a further tensile force to the cable tie.

The reverse sequential pivoting, including the initial and subsequent pivoting of the inner and outer trigger links 97, 122, causes the central, inner and outer links 167, 169, 172 to pivot. Additional disclosure of this reverse sequential pivoting is contained in U.S. patent application Ser. No. 10/614,435 filed in the USPTO on Jul. 7, 2003.

The tool head 12 may be removed from the tool handle 15 by pivoting the outer trigger link 122 in the direction 134 toward the open position, which causes the inner trigger links 97 to pivot in the direction 117 toward the open position. This, in turn, causes the rod link 142 to pivot in the direction 149 toward the open position into engagement with the trigger stop 42, as shown in FIG. 6.

Pivoting of the rod link 142 causes the detent 154 to drop below so as to clear the pull rod pin 165 such that the rod link is decoupled from the pull rod 157. In contrast, the coupling between the detent 154, pull rod yoke 162 and pull rod pin 165, shown in FIG. 6, obstructs removal of the tool head 12 from the tool handle 15. Thus, pivoting the rod link 142 in the direction 119, and deflecting the levers 66 inwardly a sufficient distance to cause the hook formations 25 to clear the adjacent latch edges 68, allows removal of the tool head 12 from the tool handle 15.

When the tool head 12 is removed from the tool handle 15, the engagement of the rod link 142 with the trigger stop 42 obstructs further pivoting of the rod link in the direction 149. This engagement of the rod link 142 with the trigger stop 42, in combination with the connections of the central, inner and outer links 167, 169, 172 to the inner and outer trigger links 97, 122 prevents the rod link and inner and outer trigger links from pivoting substantially beyond the angular positions thereof relative to the tool handle 15 when the tool head 12 is removed from the tool handle 15.

The tool head 12 may be inserted into the tool handle 15 by pivoting the outer and inner trigger links 122, 97 in the directions 134, 117 such that the rod link 142 pivots in the direction 149 into engagement with the trigger stop 42. Insertion of the tool head 12 into the passage 47 is toward the left, as shown in FIG. 6, and may be for a longitudinal distance of 10 mm. The insertion of the proximal end 20 is continued sufficiently so that the yoke web 163 of the pull rod yoke 162 engages the detent 154 of the rod link 142. Insertion of the proximal end 20 is continued causing the yoke web 163 to displace the detent 154 in the rearward direction causing rod link 142 to pivot in the direction 152 toward the closed position. As a result, the detent 154 is translated upwardly within the pull rod yoke 162 between the yoke web 163 and pull rod pin 165, as shown in FIG. 6. The detent 154, pull rod yoke 162 and pull rod pin 165 thereby define a joint which provides for coupling and decoupling of the trigger mechanism 92, which includes the rod link 142, and the tensioning mechanism, which includes the pull rod 157, based on the relative positions thereof.

The insertion of the tool head 12 rearward through the passage 47 results in the hook formations 25, including the chamfered portions thereof, engaging the inner surfaces of the portions of the shell members 33 which define the barrel 40. When the tool head 12 is sufficiently inserted into the barrel 40, the hook formations 25 clear the adjacent latch edges 68 causing outward deflection of the arms 24. This causes the hook formations 25 to engage the adjacent latch edges 68, as shown in FIG. 7, thereby to prevent removal of the tool head 12 from the barrel 40.

Alternative embodiments of the tool head 12 are possible in which the components thereof are generally heavier and stronger such that the tension force applied to the cable tie by the tool head is larger using the same tool handle 15 as is shown in FIGS. 1 and 2. For example, the tool head 12 illustrated in FIGS. 1 and 2 may provide for the application of tensile forces in the range of 18 to 50 lbs. to the cable tie. In contrast, an alternative embodiment of the tool head may provide for the application of tensile forces in the range of 50 to 120 lbs. to the cable tie.

Figures 28, 29:
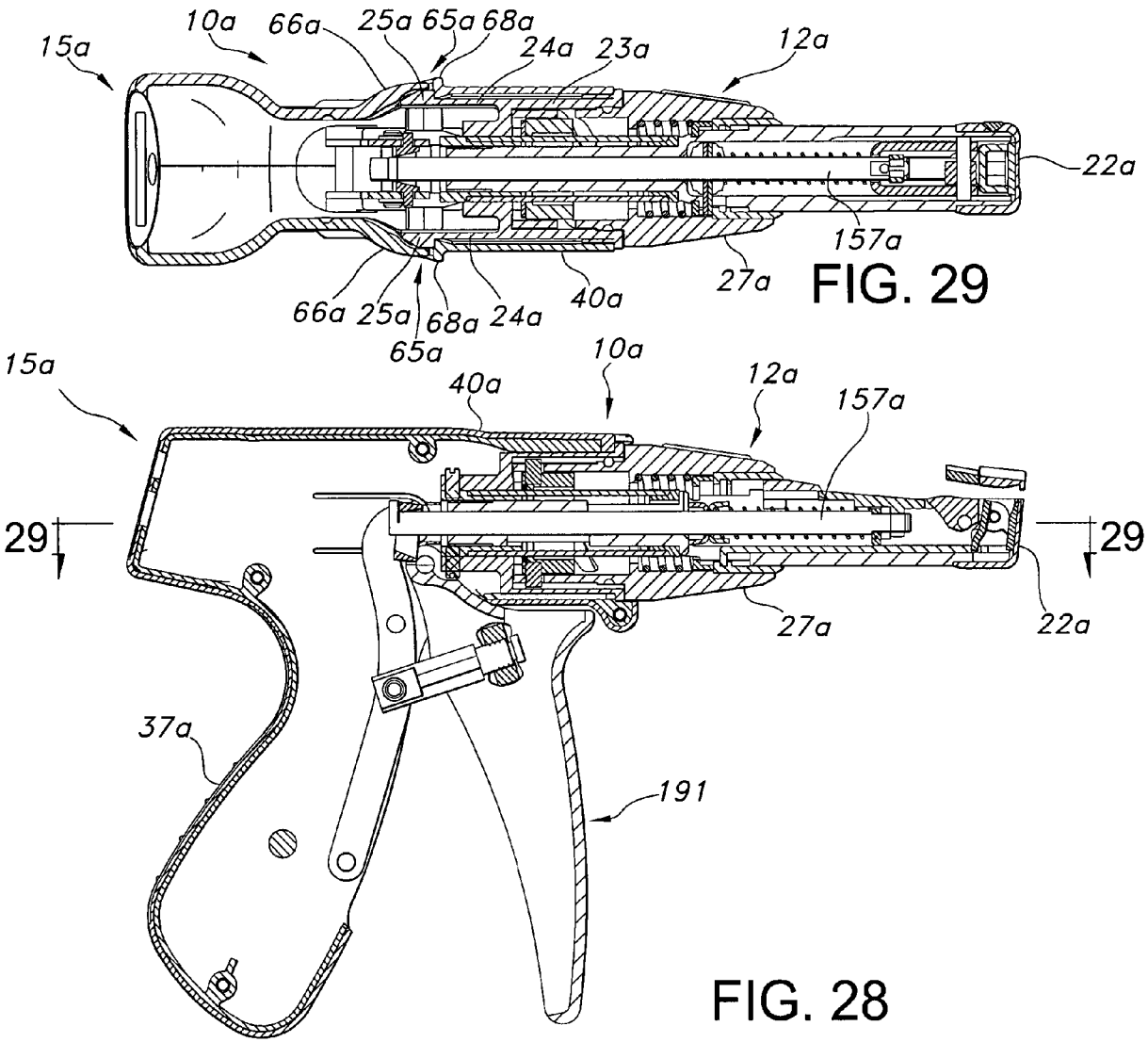
FIG. 28 is a cross-sectional view in the plane indicated by line 28—28 of FIG. 25 showing components located within the modular tool head and the linkage located within the tool handle.
FIG. 29 is a cross-sectional view in the plane indicated by line 29—29 of FIG. 28 showing components located within the modular tool head and tool handle.
Figure 30:
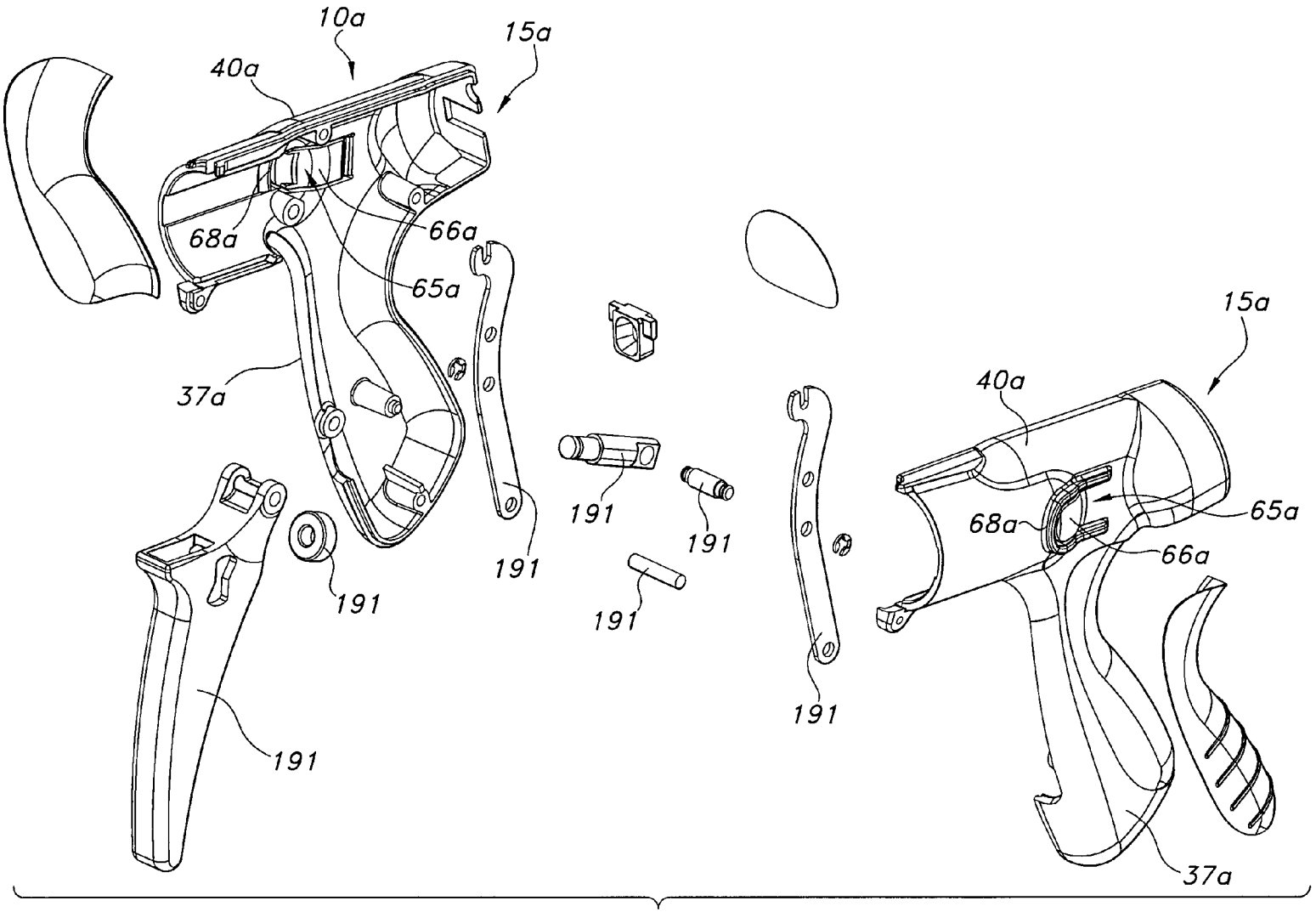
FIG. 30 is an exploded view of the tool handle of FIG. 22 showing the linkage located within the tool handle.
Figure 31:
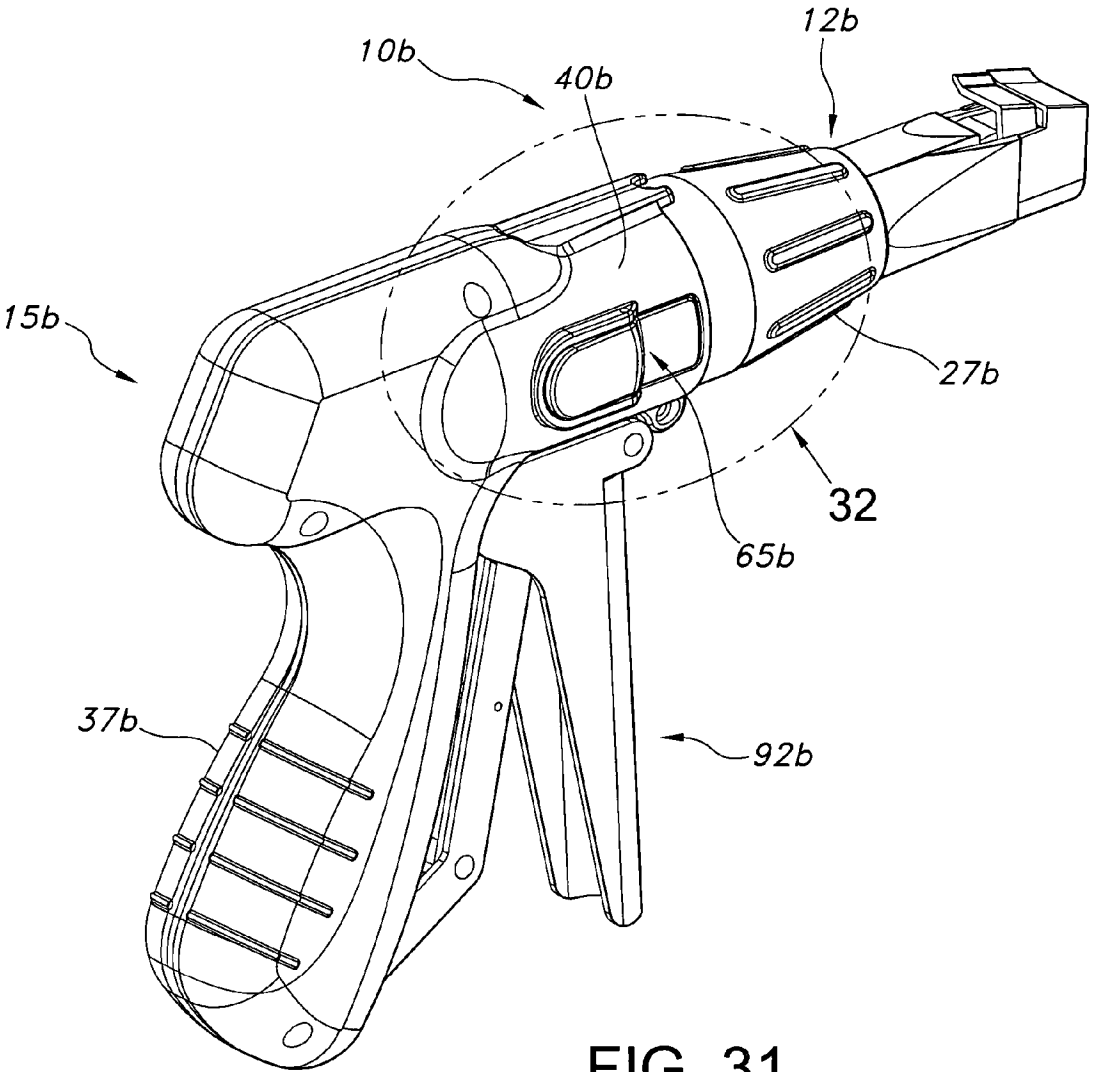
FIG. 31 is a rear perspective view of an alternative third embodiment of the cable tie tool of the present invention showing a modular tool head connected to a tool handle.

An alternative embodiment of the cable tie tool 10*a* is shown in FIGS. 22 to 30. FIGS. 22 to 26, and 28 to 30 are views which correspond to the views of FIGS. 1 to 8, respectively. Parts shown in FIGS. 22 to 30 which correspond to parts shown in FIGS. 1 to 21 have the same reference numeral as in FIGS. 1 to 21 with the addition of the suffix "a" in FIGS. 22 to 30. The tool head 12*a* is generally the same as the tool head 12 shown in FIGS. 1 to 21. The tool handle 15*a* shown in FIGS. 24 to 30 includes a trigger mechanism 191 as shown in FIGS. 28 and 30.

An alternative embodiment for the tool head 12*b* and tool handle 15*b* is shown in FIGS. 31 to 51. Parts shown in FIGS. 31 to 51 which correspond to parts shown in FIGS. 1 to 21 have the same reference numeral as in FIGS. 1 to 21 with the addition of the suffix "b" in FIGS. 31 to 51.

Figures 34, 35, 36, 37, 38, 39, 40, 41:
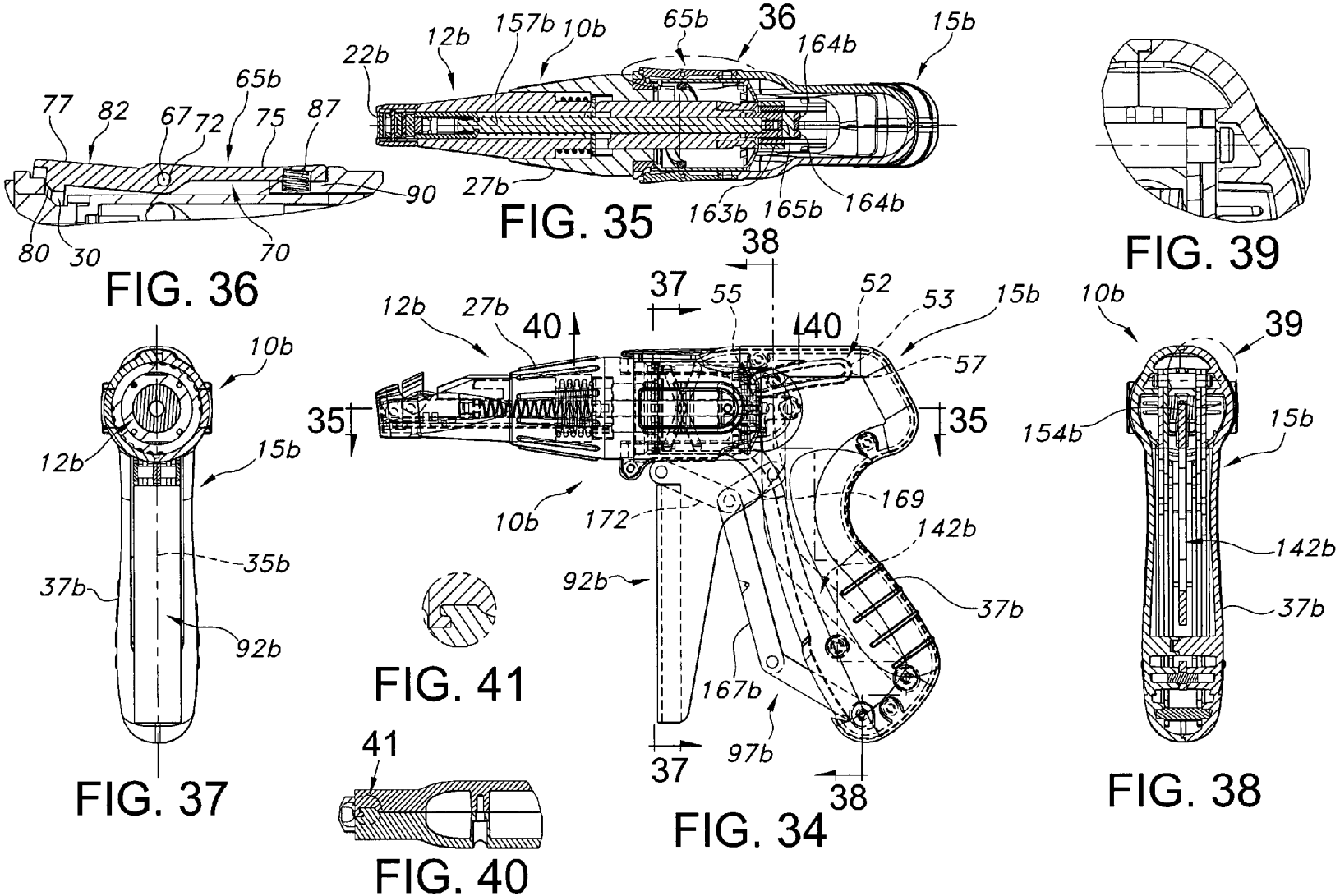
FIG. 34 is a side elevation view of the modular tool head and cable tie installation tool of FIG. 33 showing the modular tool head connected to the tool handle, the tool handle being shown as transparent to show components within the head and handle housings.
FIG. 35 is cross-sectional view in the plane indicated by line 35—35 of FIG. 34 showing components within the head and handle housings, including the latches in the open positions.
FIG. 36 is an enlarged view of the circled portion 36 of FIG. 35 showing the one of the latches in the open position.
FIG. 37 is cross-sectional view in the plane indicated by line 37—37 of FIG. 34 showing components within the head and handle housings, including the latches in the open positions.
FIG. 38 is cross-sectional view in the plane indicated by line 38—38 of FIG. 34 showing components within the handle housing, including the latches in the open positions.
FIG. 39 is an enlarged view of the circled portion 39 of FIG. 38 showing the pin through which the inner and outer trigger links are coupled.
FIG. 40 is cross-sectional view in the plane indicated by line 40—40 of FIG. 34 showing the handle housing.
FIG. 41 is an enlarged view of the circled portion 41 of FIG. 40 showing the engagement between the shell members of the handle housing portions including the distal end of the barrel.

The tool head 12*b* includes a tensioning mechanism having a tension adjustment knob 27 the outer surface of which has a circular groove 30 generally adjacent to the proximal end thereof, as shown in FIGS. 35 and 36. The circular groove 30 is contained in a plane which is generally transverse to the longitudinal axis of the tool head 12*b*.

Figure 42:
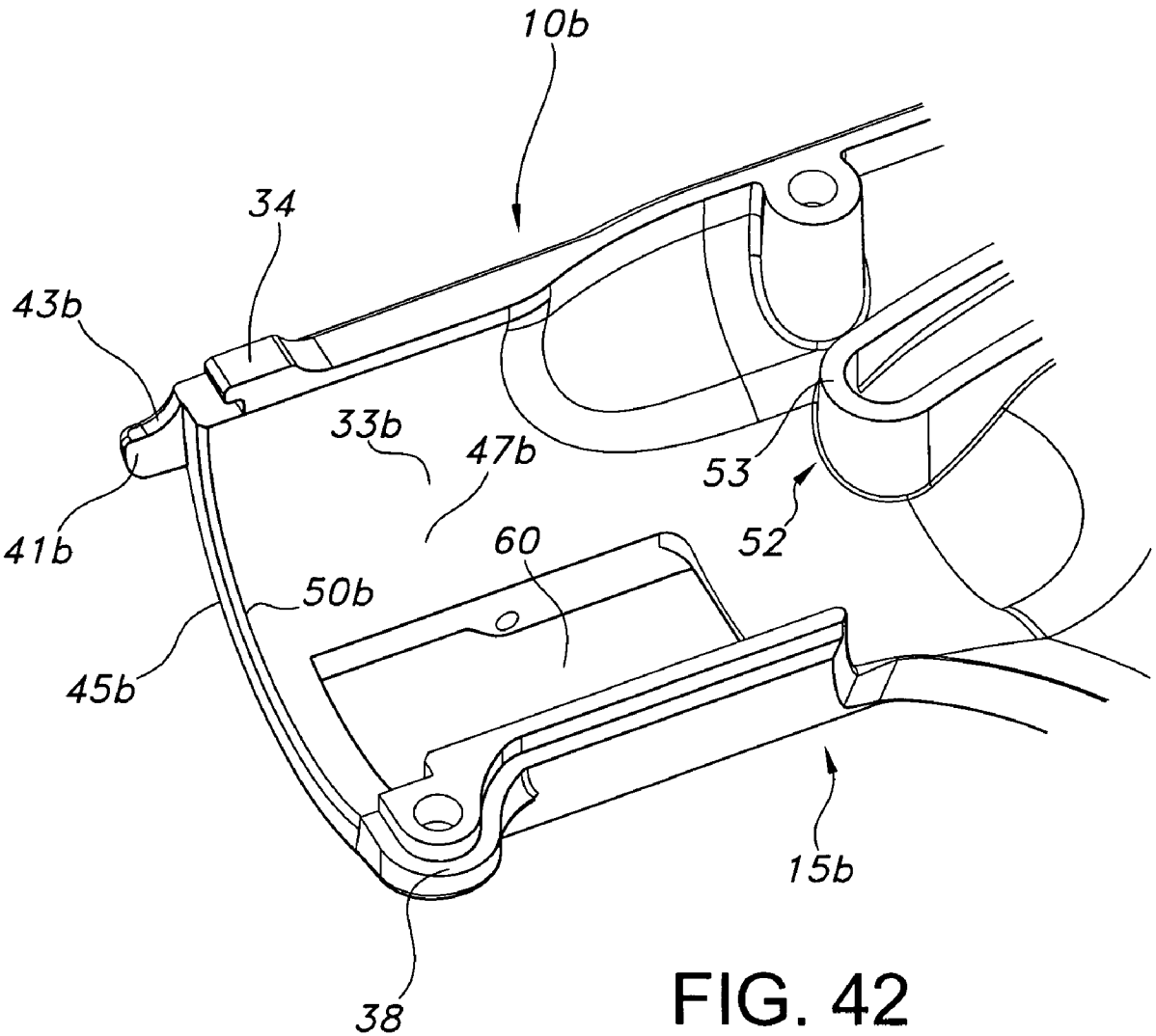
FIG. 42 is a perspective view of the interior of one of the shell members of the handle housing including the distal end of the barrel.
Figure 43:
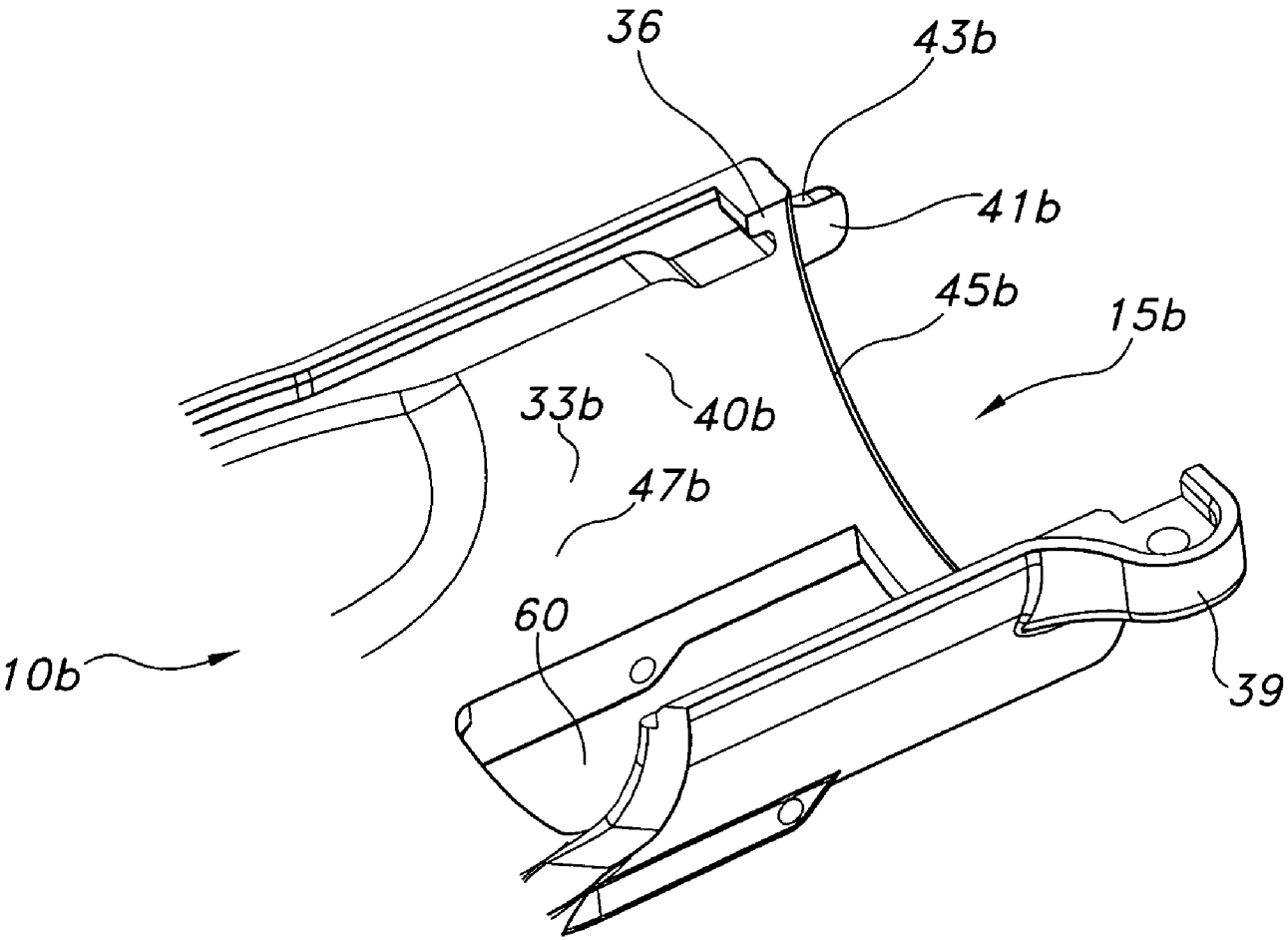
FIG. 43 is a perspective view of the interior of the other shell member of the handle housing including the distal end of the barrel.

The portions of the shell members 33*b* which form the distal end 45*b* of the barrel 40*b* are secured together by an upper hook flange 34 which is inserted into a corresponding upper catch flange 36, shown in FIGS. 42 and 43. The upper hook and catch flanges 34, 36 facilitate the connection of upper portions of the shell members 33*b* without requiring a connecting screw or similar fastener. These portions of the shell members 33*b* are further secured together by inner and outer tab flanges 38, 39 which depend from the lower portion of the distal end 45*b*. The inner and outer tab flanges 38, 39 are secured together by a connecting screw. The shell members 33*b* are assembled by first connecting the upper hook and catch flanges 34, 36, and then bringing together the inner and outer tab flanges 38*b*, 39*b* for connection by inserting the connecting screw through the passages therein.

Formed on the inner surface of each shell member 33*b* within the barrel 40*b* is an elongate track 52 defined by a rim 53 having a generally elliptical shape. The track 52 has front and rear ends 55, 57. Contained within each of the tracks 52 is a corresponding end of the pin 105*b*. The pin 105*b* extends through the upper ends of the inner trigger links 97*b*.

The barrel 40*b* has a pair of generally elongate longitudinal cutouts 60 on opposite sides thereof generally adjacent to the distal end 45*b*. The periphery of each cutout 60 has a proximal portion defined by a rim 62 which extends radially outward from the outer curved surface of the barrel 40*b*. The inner edge of each rim 62 has a curvature which matches the curvature of the barrel 40*b*. The outer edge of each rim 62 is contained in a plane which is generally parallel to the central plane 35*b*.

Figure 32:
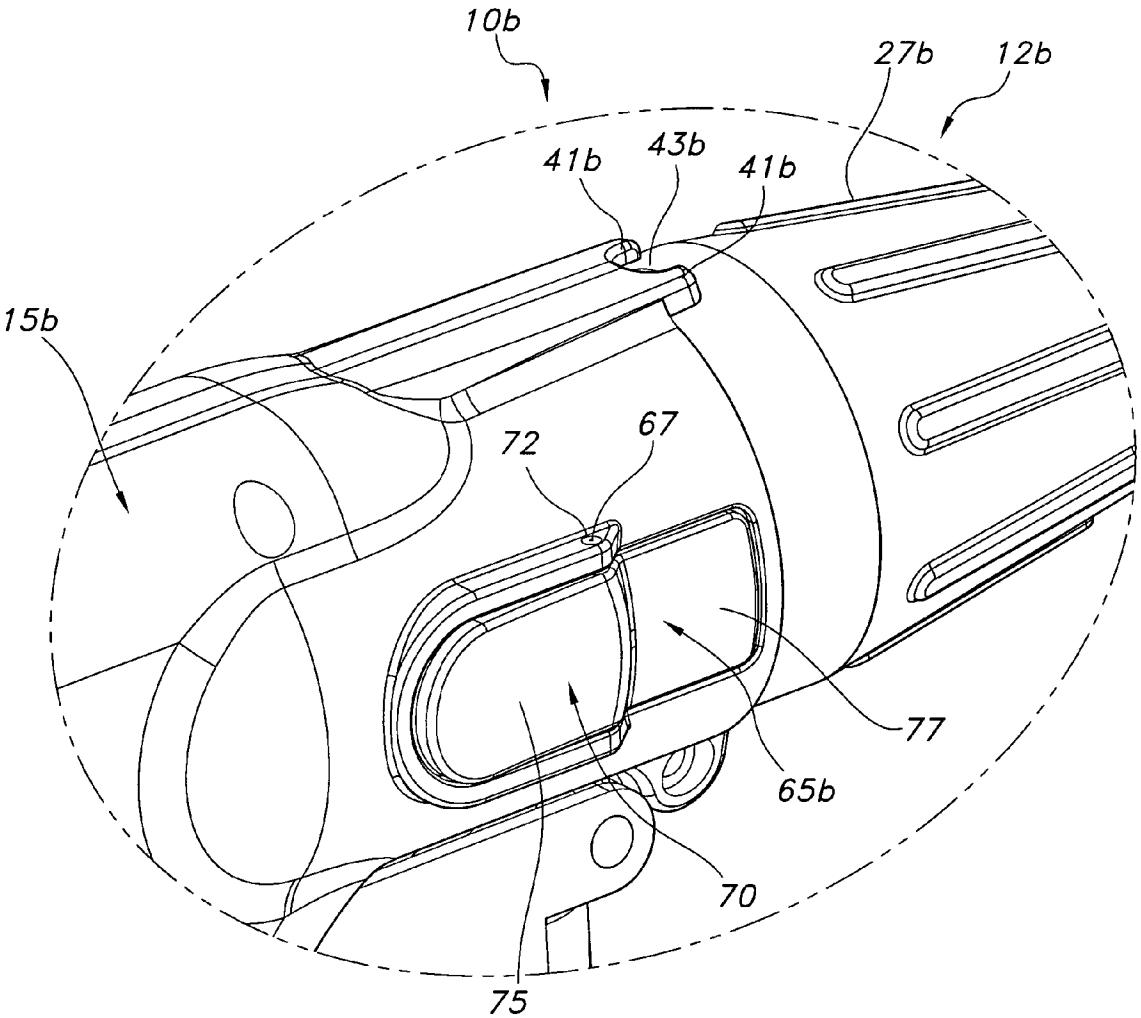
FIG. 32 is an enlarged view of the circled portion 32 of FIG. 31 showing the latch of the tool handle for securing the tool head thereto.
Figure 33:
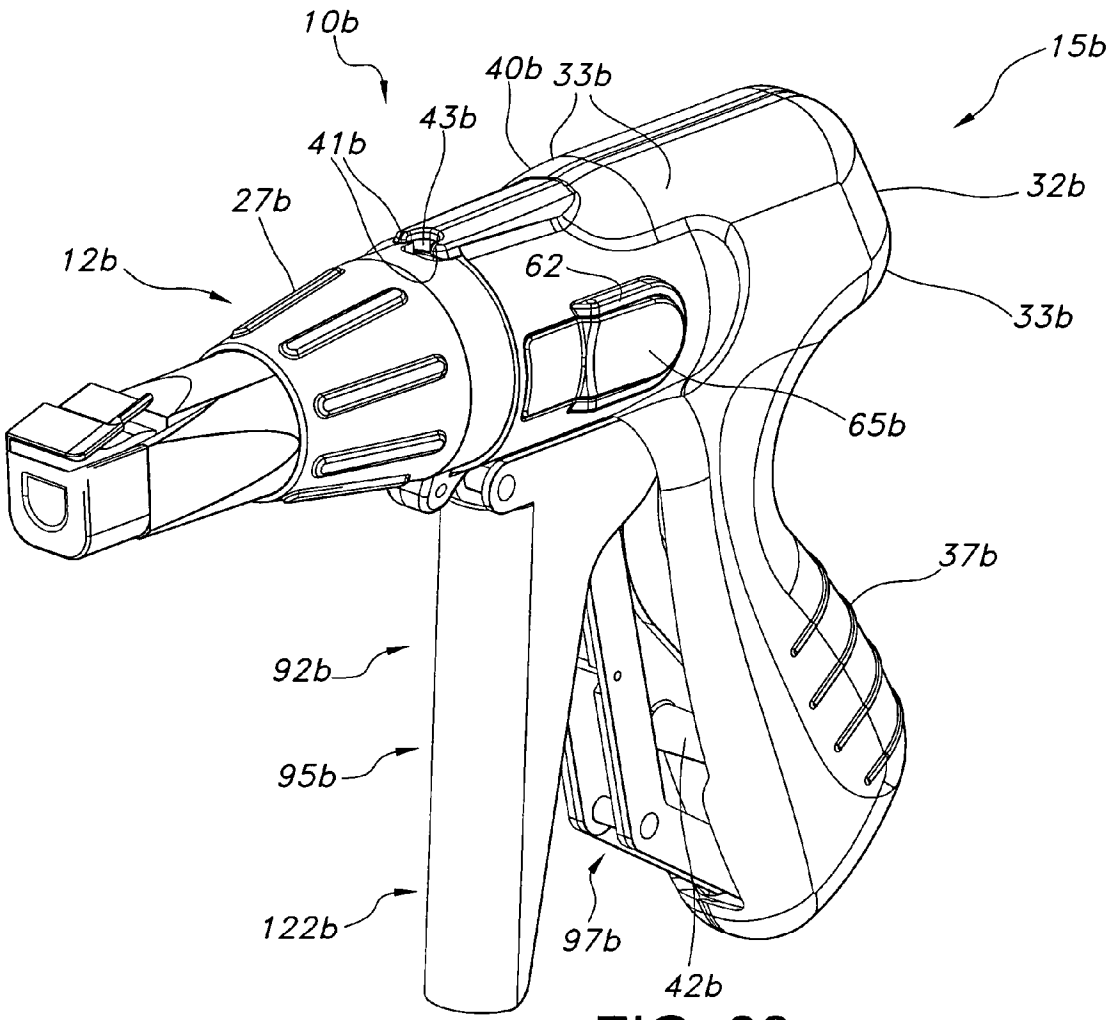
FIG. 33 is a front perspective view of the cable tie tool of FIG. 31 showing the modular tool head connected to the tool handle.

The tool handle 15*b* includes a pair of latches 65*b* each of which has a latch body 70 which is supported in a respective cutout 60 by a latch pin 67, as shown in FIGS. 32, 42 and 43. Each latch pin 67 extends through a passage 72 in the respective latch body 70. Each passage 72 is generally perpendicular to upper and lower edges of the respective latch body 70, as shown in FIGS. 34 to 36. When each latch 65*b* is supported in a respective cutout 60, the axis of the associated latch pin 67 is generally vertical relative to the upper and lower surfaces of the barrel 40*b*.

Each latch 65*b* has a periphery which corresponds to the periphery of the respective cutout 60 such that, when the latch is supported in the respective cutout, the periphery of the latch is generally adjacent to the periphery of the cutout. The portion of each latch body 70 in generally proximal relation to the passage 72 constitutes a proximal portion 75 of the latch body. The outer surface of each proximal portion 75 is generally flat, as shown in FIG. 32. Each proximal portion 75 adjoins the portion of the cutout 60 having the rim 62 which provides the outer curved surface of the barrel 40*b* with a flat portion with which the outer surface of the proximal portion may have an even relation. The inner surface of each proximal portion 75 has a curvature which matches the curvature of the inner surface of the barrel 40*b*.

The portion of each latch 65*b* in generally distal relation to the passage 72 constitutes a distal portion 77. The inner and outer surfaces of each distal portion 77 have a curvature which generally matches the curvature of the barrel 40*b*, as shown in FIGS. 32 and 37. Extending inwardly from the inner surface of each distal portion 77 generally adjacent to the distal ends thereof is a lip 80, the central plane of which is generally perpendicular to the central plane 35*b*. The inner and outer edges of each lip 80 have a curvature which generally matches the curvature of the distal portion 77.

Figures 44, 45, 46, 47, 48, 49, 50, 51:
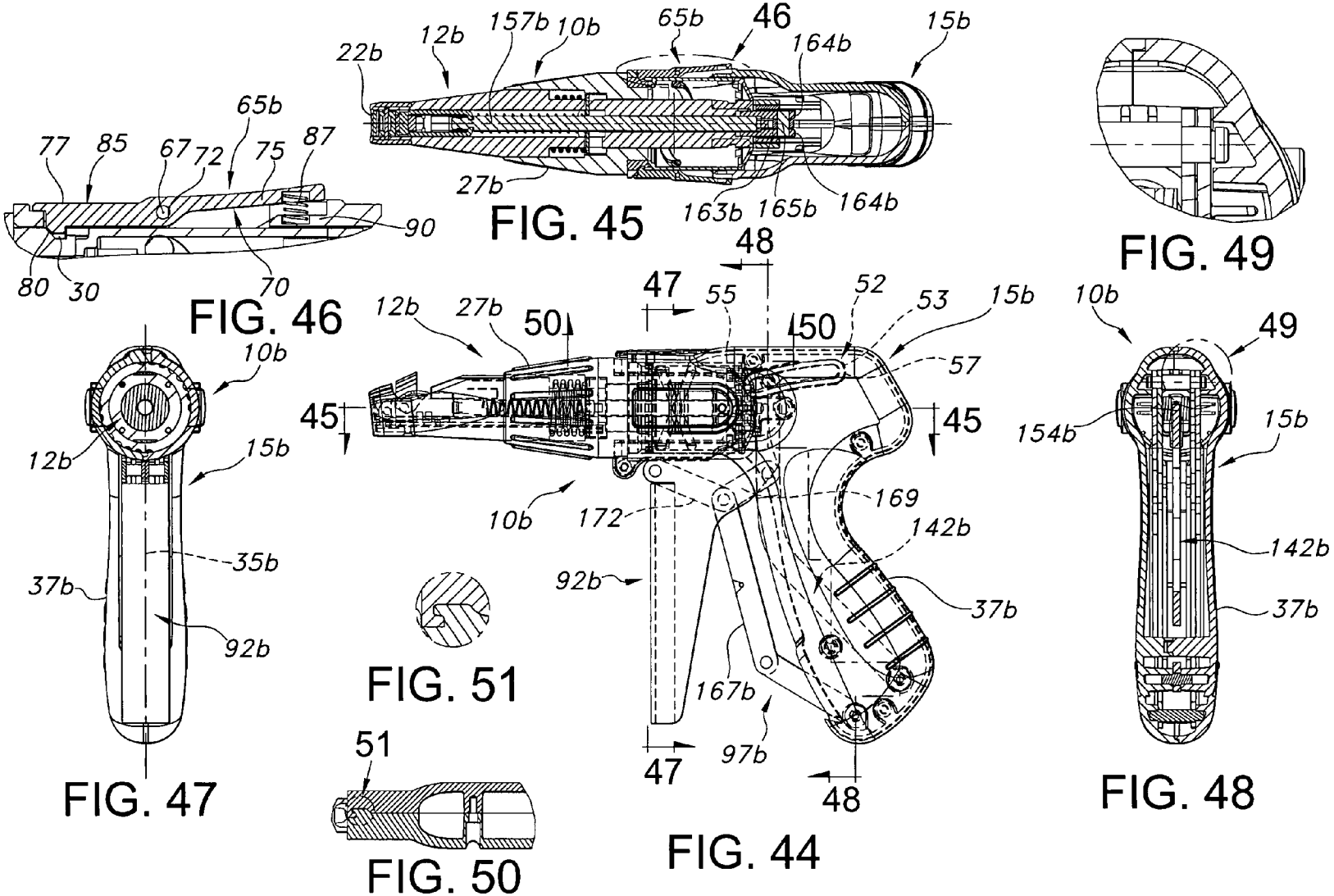
FIGS. 44 to 51 correspond to FIGS. 34 to 41, except that in FIGS. 44 to 51, the latches are shown in the closed positions.

The connection of the latches 65*b* to the barrel 40*b* enables each latch to pivot between open and closed positions 82, 85, as shown in FIGS. 36 and 46. When each latch 65*b* is in the open position 82, the proximal portion 75 of the latch body 70 is displaced inward toward the barrel 40*b* causing the distal portion 77 to pivot outwardly away from the barrel. Such inward displacement of the proximal portion 75 is resisted by a spring 87 supported on an inner shoulder 90 of the barrel 40*b* such that the spring is between the shoulder and latch, as shown in FIG. 36.

When the tool head 12*b*, including the proximal end 20, is fully inserted in the passage 47*b* of the barrel 40*b*, the circular groove 30 is longitudinally aligned with the lip 80. This alignment enables the lip 80, when displaced to the closed position 82 by the spring 87, to fit in an arcuate segment of the circular groove 30, as shown in FIG. 46. This fit of the lip 80 in the groove 30 prevents removal of the tool head 12*b* from the barrel 40*b*. Full insertion of the tool head 12*b* into the passage 47*b* of the barrel 40*b* results in the proximal end 20*b* of the tool head being longitudinally to the rear of the distal end 45*b* of the barrel, as shown in FIG. 34.

The pivotal connections between the inner and outer trigger links 97*b*, 122*b* provided by the pin 105*b* provides for the outer trigger link to pivot in the directions 134*b*, 137*b* toward open and closed positions, respectively. The ends of the pin 105*b* are contained within the corresponding rims 53 of the tracks 52 such that pivoting of the inner trigger links 97*b* in the directions 117*b*, 119*b* causes the pin 105*b* to translate longitudinally within the track. When the inner trigger links 97*b* are pivoted in the direction 117*b* to the open position, the pin 105*b* approaches the front end 55 of the track 52 but does not reach it resulting in a longitudinal clearance between the pin 105*b* and the front end 55. When the inner trigger links 97*b* are pivoted in the direction 119*b* to the closed position, the pin 105*b* approaches the rear end 57 of the track 52 but does not reach it resulting in a longitudinal clearance between the pin 105*b* and the rear end 57. The lateral clearances between the ends of the pin 105*b* and the portion of the handle housing 32*b* contained within the rim 53 is sufficiently limited to limit any lateral deflection of the upper ends of the inner and outer trigger links 97*b*, 122*b* which may result from the cantilevered support of these links by the pin 100*b*.

Pivoting the rod link 142*b* in the direction 119*b* and pivoting the latches 65*b* to the open positions 82, against the resistance of the respective springs 87, allows removal of the tool head 12*b* from the tool handle 15*b*.

The tool head 12*b* may be inserted into the tool handle 15*b* by pivoting the outer and inner trigger links 122*b*, 97*b* in the directions 134*b*, 117*b* such that the rod link 142*b* pivots in the direction 149*b* into engagement with the trigger stop 42*b*. The latches 65*b* are pivoted to the open positions 82 against the resistance of the springs 87.

When the tool head 12*b* is fully inserted into the tool handle 15*b*, the latches 65*b* are released allowing forcible pivoting thereof by the springs 87 to the respective closed positions 85 shown in FIG. 46. This causes the lips 80*b* of the latches 65*b* to fit into a respective arcuate segment of the circular groove 30, as shown in FIG. 46, thereby to mount and retain the tool head 12*b* to the handle housing 32*b*.

The entire disclosure of U.S. Pat. No. 5,915,425 issued Jun. 29, 1999 is hereby incorporated by reference herein. The entire disclosures of U.S. patent application Ser. No. 10/614,435 filed in the USPTO on Jul. 7, 2003, U.S. patent application Ser. No. 29/185,985 filed in the USPTO on Jul. 7, 2003 and U.S. patent application Ser. No. 29/185,986 filed in the USPTO on Jul. 7, 2003 are each hereby incorporated by reference herein. The entire disclosures of U.S. Provisional Patent Application No. 60/544,361 filed in the USPTO on Feb. 13, 2004, U.S. Provisional Patent Application No. 60/544,362 filed in the USPTO on Feb. 13, 2004, and U.S. Provisional Patent Application No. 60/544,472 filed in the USPTO on Feb. 13, 2004 are each hereby incorporated by reference herein. The entire disclosure of the U.S. Patent application Ser. No. 11/056,078, filed in the USPTO on even date herewith and entitled "Tension and Anti-Recoil Mechanism for Cable Tie Tool", having as the inventors Joey D. Magno, Jr., Johan Tapper, Anders Fahlen, Joakin Norin, Goran Paulsson and Sven Wadling, and is hereby incorporated by reference herein. The entire disclosure of the U.S. patent application Ser. No. 11/055,938, filed in the USPTO on even date herewith and entitled "Cycle Counter for Cable Tie Tool", having as the inventor Joey D. Magno, Jr., is hereby incorporated by reference herein.

While the invention has been described by reference to certain preferred embodiments, it should be understood that numerous changes could be made within the spirit and scope of the inventive concept described. Accordingly, it is intended that the invention not be limited to the disclosed embodiments, but that it have the full scope permitted by the language of the following claims.

What is claimed is:

1. A modular tool head for a cable tie tool having a tool handle, said tool head comprising a latch mechanism for securing said tool head to the tool handle, said latch mechanism comprising a lever connected to the tool handle, said lever being movable to engage said tool head for deflection thereof away from the tool handle to disengage said securing of said tool head from the tool handle.

2. A modular tool head for a cable tie tool having a tool handle, said tool head comprising a latch mechanism for securing said tool head to the tool handle, the cable tie tool has having a trigger mechanism mounted in the tool handle, said modular tool head comprising a plurality of modular tool heads, each of said tool heads comprising a latch mechanism for securing said corresponding tool head to the tool handle, each of said tool heads further comprising a tensioning mechanism for applying a tension force to a cable tie, each of said tool heads further comprising a joint for coupling said corresponding tensioning mechanism to the trigger mechanism such that a gripping force applied to the trigger mechanism is transmitted to said corresponding tensioning mechanism, said joint providing for coupling and decoupling of the trigger mechanism and said tensioning mechanism based on the relative positions thereof;

each of said tensioning mechanisms providing for application of a corresponding tension force to the cable tie proportional to the force applied to said respective tensioning mechanisms by the trigger mechanism, the respective tension forces being different for at least one uniform force applied by the trigger mechanism to said corresponding tensioning mechanisms.

3. A modular tool head for a cable tie tool having a tool handle including a trigger mechanism mounted therein, the trigger mechanism including a rod link supported within the tool handle for pivoting relative thereto, said tool head comprising:

a tensioning mechanism mounted in said tool head, said tensioning mechanism providing for application of a tension force to a cable tie; and a joint for coupling said tensioning mechanism to the rod link such that a gripping force applied to the trigger mechanism is transmitted to said tensioning mechanism, said joint providing for coupling and decoupling of the rod link and said tensioning mechanism based on the relative positions thereof, said joint comprising a trigger stop fixed to the tool handle such that said trigger stop is between the rod link and an opening in the tool handle, said trigger stop obstructing the pivoting of the rod link toward the opening in the tool handle to prevent a substantial displacement of the rod link through the opening and beyond the tool handle when said tool head is unsecured from the tool handle.

4. A modular tool head for a cable tie tool having a tool handle, said tool head comprising a latch mechanism for securing said tool head to the tool handle, said latch mechanism comprising a hook formation which extends from said tool head, said latch mechanism further comprising a latch edge formed on the tool handle, said latch edge providing a connection for said hook formation for said securing of said tool head to the tool handle.

5. A modular tool head according to claim 4, wherein said latch mechanism comprises a lever connected to the tool handle, said lever being movable to engage said hook formation for deflection thereof away from said latch edge to disengage said securing of said tool head from the tool handle.

6. A modular tool head according to claim 4, wherein said hook formation is located within the tool handle for said securing of said tool head to the tool handle.

7. A modular tool head according to claim 5, wherein said lever and latch edge are located outside of said hook formation for said securing of said tool head to the tool handle, said lever being movable inward for said engagement with said hook formation for deflection thereof away from said latch edge for said disengagement of said securing of said tool head from the tool handle.

8. A modular tool head according to claim 2, wherein said tool head comprises a pull rod supported therein for axial reciprocation relative thereto, the trigger mechanism including a rod link supported within the tool handle for pivoting relative thereto, said joint comprising a detent fixed to the rod link, said joint further comprising a pull rod yoke secured to said pull rod, said pull rod and the rod link being movable relative to one another to provide for insertion of said detent into said pull rod yoke for said coupling of said tensioning mechanism to the trigger mechanism.

9. A modular tool head according to claim 8, wherein said pull rod yoke comprises a pair of yoke flanges connected to a yoke web, said joint comprising a pull rod pin connected to said yoke flanges to close said pull rod yoke, said closure of said pull rod yoke providing for said pull rod yoke to follow said detent when said detent is inserted in said pull rod yoke and said detent is displaced.

10. A modular tool head according to claim 8, wherein said joint comprises a trigger stop fixed to the tool handle such that said trigger stop is between the rod link and an opening in the tool handle, said trigger stop obstructing the pivoting of the rod link toward the opening in the tool handle to prevent a substantial displacement of the rod link through the opening and beyond the tool handle when said tool head is unsecured from the tool handle.

* * * * *